United States Patent [19]

Coleman

[11] Patent Number: 4,725,831

[45] Date of Patent: Feb. 16, 1988

[54] HIGH-SPEED VIDEO GRAPHICS SYSTEM AND METHOD FOR GENERATING SOLID POLYGONS ON A RASTER DISPLAY

[75] Inventor: Terrence J. Coleman, Des Plaines, Ill.

[73] Assignee: XTAR Corporation, San Diego, Calif.

[21] Appl. No.: 604,863

[22] Filed: Apr. 27, 1984

[51] Int. Cl.[4] ..... G09G 1/16

[52] U.S. Cl. ..... 340/747; 340/723; 340/798

[58] Field of Search ..... 340/717, 723, 747, 750, 340/798

[56] References Cited

U.S. PATENT DOCUMENTS

| | | | |
|---|---|---|---|
| 3,925,776 | 12/1975 | Swallow | 340/717 |
| 4,119,956 | 10/1978 | Murray . | |
| 4,152,766 | 5/1979 | Osofsky et al. . | |
| 4,179,823 | 12/1979 | Sullivan et al. . | |
| 4,179,824 | 12/1979 | Marsh . | |
| 4,208,719 | 6/1980 | Lotz et al. . | |
| 4,225,861 | 9/1980 | Langdon, Jr. et al. . | |
| 4,257,044 | 3/1981 | Fukuoka . | |
| 4,300,136 | 11/1981 | Tsuiki et al. . | |
| 4,308,532 | 12/1981 | Murphy . | |
| 4,318,097 | 3/1982 | Oura . | |
| 4,319,339 | 3/1982 | Utzerath . | |
| 4,338,599 | 7/1982 | Leininger . | |
| 4,346,377 | 8/1982 | Green . | |
| 4,367,466 | 1/1983 | Takeda et al. . | |
| 4,371,872 | 2/1983 | Rossman . | |
| 4,386,345 | 5/1983 | Narveson et al. . | |
| 4,425,559 | 1/1984 | Sherman . | |
| 4,458,330 | 7/1984 | Imsand et al. | 340/747 |
| 4,528,642 | 7/1985 | Waller | 340/747 |
| 4,538,144 | 8/1985 | Yamagami | 340/747 |

OTHER PUBLICATIONS

Sorensen, Peter, *The Next Best Thing to Flying,* Technology Illustrated, Jun. 1983, pp. 20–26.

Perry, T. S., Video games: *the Next Wave,* IEEE Spectrum, Dec. 1983, pp. 52–59.

Perry, T., et al., *Video games: the Electronic Big Bang,* IEEE Spectrum, Dec. 1982, pp. 20–33.

O. Blazek, et al., "Raster Scan Graphics with Zoom and Pan," Hewlett-Packard Journal, Jan. 1978, pp. 6–12.

*Primary Examiner*—Marshall M. Curtis

*Attorney, Agent, or Firm*—Woodard, Emhardt, Naughton, Moriarty & McNett

[57] ABSTRACT

A real-time video graphics system for generating solid polygons on a raster display screen from X-Y vertex coordinates of the polygons. Solid objects are defined in a host processor system as three-dimensional polygons. The host processor calculates the X-Y vertex coordinates for each polygon and deposits them, along with a corresponding instruction and pixel video data, in a shared RAM. The video graphics system obtains the instruction and data from the shared RAM and calculates from the X-Y vertex coordinates the X coordinates of the left and right edges of each solid polygon for each horizontal line of the display. The system writes pixel data for a horizontal stripe of 32 pixels into a frame buffer in one frame buffer memory write cycle of approximately 320 nanoseconds. Pixel data is periodically read out of the frame buffer, one complete stripe at a time, and shifted out serially to refresh the display screen.

16 Claims, 15 Drawing Figures

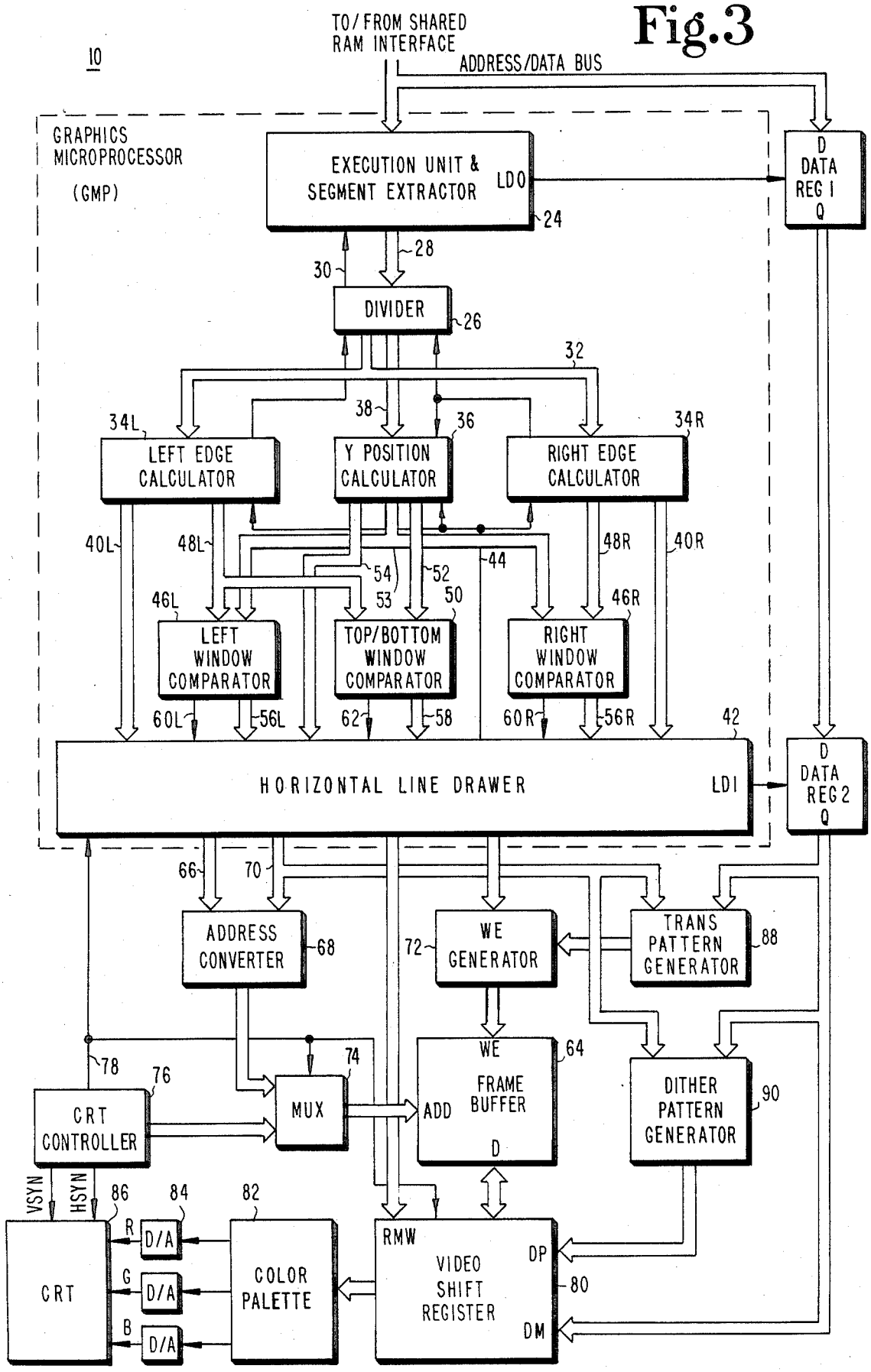
Fig.3
10
TO/FROM SHARED RAM INTERFACE
ADDRESS/DATA BUS
GRAPHICS MICROPROCESSOR (GMP)
EXECUTION UNIT & SEGMENT EXTRACTOR
LDO
24
D DATA REG 1 Q
28
30
DIVIDER
26
32
38
36
34L
34R
LEFT EDGE CALCULATOR
Y POSITION CALCULATOR
RIGHT EDGE CALCULATOR
40L
48L
48R
40R
44
54
52
53
50
46L
46R
LEFT WINDOW COMPARATOR
TOP/BOTTOM WINDOW COMPARATOR
RIGHT WINDOW COMPARATOR
60L
56L
62
58
60R
56R
42
HORIZONTAL LINE DRAWER
LDI
D DATA REG 2 Q
66
70
ADDRESS CONVERTER
68
72
WE GENERATOR
TRANS PATTERN GENERATOR
88
78
76
74
64
CRT CONTROLLER
MUX
WE
ADD
FRAME BUFFER
D
DITHER PATTERN GENERATOR
90
VSYN
HSYN
86
84
82
CRT
R
G
B
D/A
D/A
D/A
COLOR PALETTE
RMW
VIDEO SHIFT REGISTER
DP
DM
80

Y POSITION CALCULATOR

REM
REM. REG
414
2R
R
D
C
4 — TO — 1 MUX
424
428
-ΔY
-ΔY REG
412
B
2(-ΔY)
A
-ΔY
430
448
446
Σ
A
B
A MUX Y
B
434
D
ACCUMULATOR
Q
CO
420
LEFT EDGE CALCULATOR

ΔY CTR
410
422
425
426
432
402
ECRDYL
LAST
FIRST
L/R̄
DIVRDY
CONTROL
FSTL
LDLOAD
DATARDYL
ΔXS
ΔXS REG
408
454
452
450
436
438
442
458
459
456
+1
C
D
4 — TO — 1 MUX
400
440
444
Σ
A
B
B
MUX
Y
418
416
D
XPOS REGISTER
Q
B
MUX
Y
A
D
X OUTPUT
Q
XL
406
ΔX/ΔY REG
D
Q
ΔX/ΔY
XTOP
460
XBOT
404
XBOTTOM REG

WRITE ENABLE GENERATOR

TRANSLUCENCY PATTERN GENERATOR

DITHER PATTERN GENERATOR

SHIFT REGISTER, READ-MODIFY-WRITE, DITHER CIRCUITRY

HIGH-SPEED VIDEO GRAPHICS SYSTEM AND METHOD FOR GENERATING SOLID POLYGONS ON A RASTER DISPLAY

BACKGROUND OF THE INVENTION

This invention relates to video graphics systems and particularly to systems for generating complex graphic images on raster display screens.

Computer-generated images of landscapes and the like formed from terrain maps stored in computer memory are finding increasing use in flight simulation and real-time animation systems. High speed graphics systems are also finding use in computer-aided design (CAD) systems for computer simulation of dynamic behavior of automobiles, aircraft, engines and machine parts. True high-speed color graphics systems have heretofore required complex and very expensive hardware.

Generating complex images on a CRT at real-time rates of 24 or more frames per second requires the ability to rapidly draw graphical primitives, i.e., points, lines and polygons, into a display memory, or frame buffer. Vector generators, which can render a line drawing of an object, given its end points, by moving a cathode ray tube (CRT) beam continuously from a starting point to an ending point, have been employed to draw polygonal areas. However, with this technique, a multi-sided filled-in polygon which is to be drawn must be decomposed into a group of straight lines and a separate command must be given for each line which is to drawn. This technique seriously hinders the system's ability to draw complex imges in real time.

Raster displays, which use horizontal scan lines like a conventional television, fill inside areas of polygons easily, however again, the overall speed with which geometric shapes can be drawn is too slow for real-time simulation. An entire frame of pixel data is stored in the frame buffer in the raster display system. Conventionally, the picture information for each pixel has been calculated individually by a host processor and stored sequentially into the frame buffer. This information is then read from the frame buffer in synchronism with the active scan of the display beam to display the polygonal area. An exorbitant amount of host processor time is required for the calculations necessary to fill the frame buffer, such that real-time simulations and animation are not possible with standard microprocessors. CRT controller chips can draw about 10 times as fast as microprocessors but still fall far short of the speed required for real-time graphics display.

A technique for increasing the speed with which three dimensional images can be handled in graphics systems involves two processors, a host processor and a video processor, operated in parallel and communicating with each other by instructions left in a common memory area. The host processor handles all the mathematical manipulations of the X, Y and Z coordinates of each vertex for each polygon in a three dimensional scene and outputs corresponding X and Y coordinates for a two dimensional projection from a given vantage point into the common memory area.

Sherman, in U.S. Pat. No. 4,425,559, shows a raster-type polygon display apparatus which generates polygonal areas displayed by creating line segments that are used to form boundaries of the polygonal areas. A microprocessor supplies binary information describing each line segment boundary in terms of the X and Y coordinates of the line's starting point, the slope of the line segment, and the horizontal scan line in which the line segment terminates. During generation of each horizontal line, the binary information for each line segment is accessed from a shared RAM and checked to determine if the line segment is to appear on the display screen during the next successive horizontal scan line. If so, the color data word is used as a control signal and is stored in a line buffer RAM at a memory location corresponding to the horizontal position of the line segment on the next successive horizontal line. During the display scan of the next succeeding horizontal line, the memory locations of the output line buffer are read in synchronism with the movement display beam. As each control signal is encountered and accessed, it is used to set the chroma and luminance of the beam until changed by the next encountered control signal. Two line buffers are employed, and as one line buffer is being read, data for the next succeeding horizontal line is being written into the other line buffer.

The Sherman technique requires the host processor to calculate the slope of all line segments, a time-consuming task because the calculation involves a division process. The speed of this system is necessarily limited as a result. Furthermore, this apparatus returns the scanning beam to the background color/luminance state once the right line segment boundary of a polygon is reached. The display of general background color and luminance on the display screen results in a severe limitation of the system in that overlapping polygons may not be displayed without rendering the right side of a partially covered polygon invisible.

SUMMARY OF THE INVENTION

The present invention provides a high-speed video graphics system for generating solid polygons on a raster display. The video graphics system generates solid polygons from polygon data received from a data source, the polygon data including pixel video data and the X-Y vertex coordinates for each solid polygon. The system includes means for calculating from the X-Y vertex coordinates the X coordinates of the left and right edges of each solid polygon for each horizontal line of the display. The system writes pixel data for a portion of a frame into a frame buffer in one frame buffer memory write cycle, the frame portion including a plurality of adjacent pixels. Pixel data is periodically read out of the frame buffer to refresh the display screen.

According to one aspect of the invention, the duration of the frame buffer memory write cycle is less than or equal to the scan time associated with displaying the frame portion on the raster display.

According to another aspect of the invention, the system writes pixel data in parallel into the frame buffer for at least 16 pixels.

BRIEF DESCRIPTION OF THE DRAWINGS

FIG. 3 is a block diagram showing in greater detail the structure of video processor and monitor 10 of FIG. 1.

DESCRIPTION OF THE PREFERRED EMBODIMENT

Figure 1:
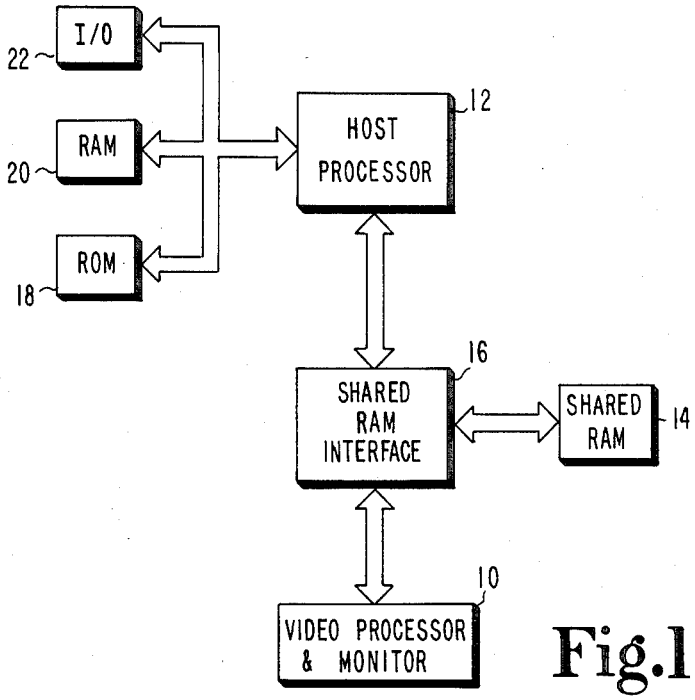
FIG. 1 is an overall system block diagram showing the video graphics system of the present invention in its operating environment with a host processor and a shared RAM.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The following table of contents is included to assist in the reading and comprehension of the description of the preferred embodiment:

TABLE OF CONTENTS

| | |
|---|---|
| I. | System Overview |
| II. | General Description of Video Processor & Monitor |
| III. | Execution Unit and Segment Extractor |
| IV. | Divider |
| V. | Y Position Calculator |
| VI. | Left and Right Edge Calculators |
| VII. | Window Comparators |
| VIII. | Horizontal Line Drawer |
| IX. | Write Enable Generator |
| X. | Translucency Pattern Generator |
| XI. | Dither Pattern Generator |
| XII. | Video Shift Register |

I. SYSTEM OVERVIEW

An overall system block diagram showing the video graphics system of the present invention in the preferred operating environment including a host processor and a shared RAM is shown in FIG. 1. Video processor and monitor 10 communicates with a general-purpose host microprocessor 12 through a shared RAM 14 and a shared RAM interface 16. The system is controlled by the host processor 12 which executes instructions stored in its ROM 18. Processor 12 uses a RAM 20 for temporary storage and communicates with control input transducers and other peripheral devices through I/O 22. While the host processor may be any general-purpose microprocessor, the system is simplified if the host has a 16-bit data bus.

Video processor and monitor 10 includes a graphics microprocessor (GMP) which executes instructions deposited by host processor 12 in shared RAM 14. The host processor merely has to modify the instructions in the shared RAM in order to change the data that is written into a frame buffer and displayed on the screen in video processor and monitor 10.

Figure 2:
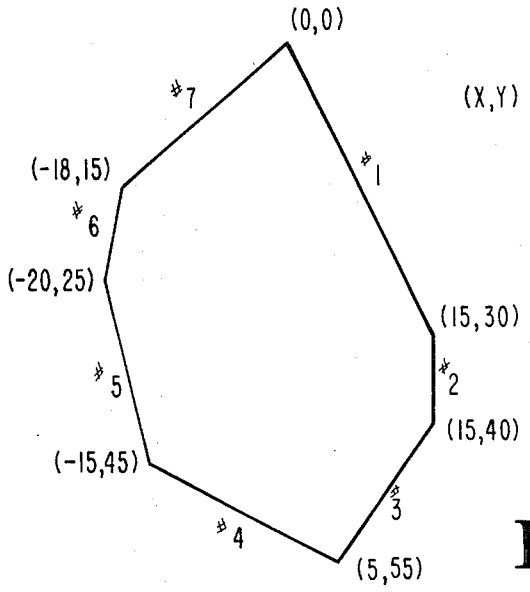
FIG. 2 is a diagram of the outline of a typical two-dimensional projection of a polygon.
Figure 4:
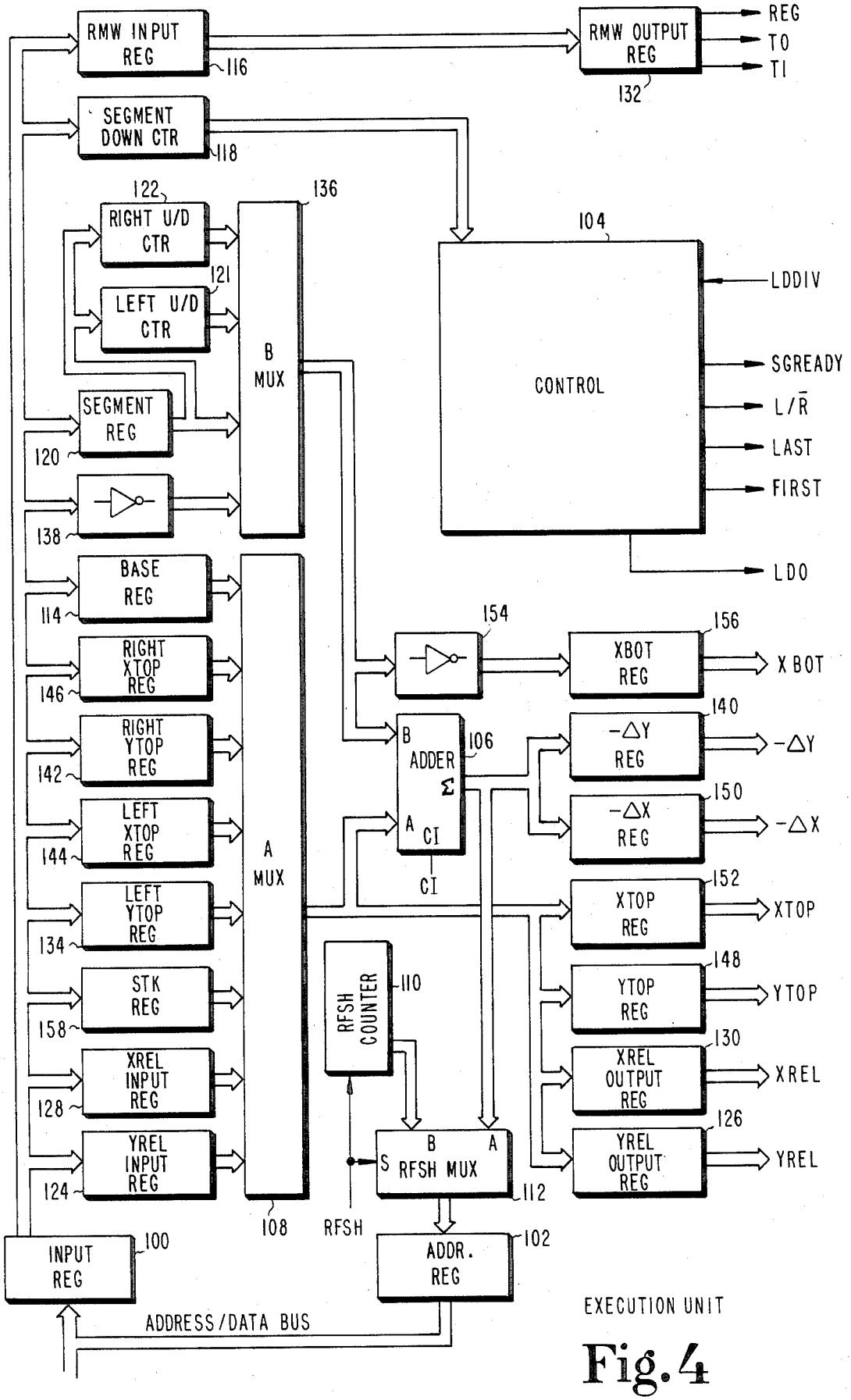
FIG. 4 is a block diagram of the execution unit and segment extractor shown in FIG. 3.

All the objects in a three-dimensional scene, such as a terrain map, are defined in the host processor system as polygons, with each vertex of each polygon having an X, Y, and Z coordinate which is stored in host memory. Any combination of RAM and ROM may be used for storage of the three-dimensional objects in the host memory, for example, various combinations of RAM 20 and ROM 18. The shared RAM may also alternatively be any combination of RAM or ROM, but if animation is to be performed, at least part of the memory must be RAM. Based on input commands from I/O 22, host processor 12 performs all of the mathematical calculations necessary to generate X and Y coordinates of a two-dimensional projection onto a desired viewing plane of the set of polygons in the three-dimensional scene. Host processor 12 stores the data defining the graphical primitives, i.e., points, lines and polygons, in shared RAM 14 through interface 16, along with corresponding instructions for video processor 10. A diagram of a typical two-dimensional projection of a polygon is shown in FIG. 2. A Cartesian coordinate system is employed, with X coordinates increasing from left to right and Y coordinates increasing from top to bottom and the origin of the coordinate system in the center of the top horizontal line in the display. The vertices are stored with the corresponding instruction in shared RAM 14 and are specified in clockwise order around the polygon, although the list of vertices may start with any one vertex.

Video processor and monitor 10 fetches instructions from shared RAM 14 and performs all the necessary calculations and operations to draw the graphical primitives into the frame buffer. The GMP is capable of drawing a filled-in polygon upon execution of one instruction which includes the color of the polygon, the number of vertices and the coordinates of each vertex.

The host processor and the video processor operate in parallel, communicating with each other when necessary through the shared system. Video processor 10 executes its own set of instructions, moving from one command to the next without host processor intervention, while host processor 12 performs calculations or responds to input commands on its own local system. Conversely, host processor 12 can access shared RAM 14 while video processor 10 is executing instructions. Shared RAM interface 16 is designed so that the host processor 12 and video processor 10 have access to the shared RAM 14 the same amount of time: Shared RAM memory cycles are interleaved between host processor 12 and video processor 10 whereby each has access to the shared RAM on alternate memory cycles.

With the GMP algorithm, the outline and interior of a polygon are drawn at the same time, one horizontal line at a time, starting at the polygon vertex with the smallest Y coordinate and proceeding to the vertex with the largest Y coordinate. In the system described herein, the smallest Y coordinate is at the top of the polygon, thus, the polygon is drawn from top to bottom. Each horizontal line is drawn from the left edge of the polygon to the right edge. For each Y coordinate, that is, for each horizontal line of the raster scan display, the system simultaneously calculates the X coordinates of the left and right edges of the polygon.

II. GENERAL DESCRIPTION OF VIDEO PROCESSOR & MONITOR

The video graphics system of the present invention will first be generally described, with reference to FIGS. 2 and 3. FIG. 3 shows in block diagram form the circuitry included in video processor and monitor 10 and additionally shows the ADDRESS/DATA bus connecting that circuitry to shared RAM interface 16. The circuitry which comprises the graphics microprocessor (GMP) is shown in broken lines.

Execution unit and segment extractor 24 (hereafter execution unit 24) is responsible for controlling the execution of the GMP instruction set. With reference to the PDRW instruction, the instruction for drawing a polygon, which will be described in greater detail hereafter, the first task of execution unit 24 upon decoding the PDRW instruction operation code (opcode) is to scan the polygon vertices stored in the shared RAM to find the top vertex, that is, the vertex with the smallest Y coordinate. The outline of a polygon consists of line segments extending between the polygon vertices, as shown in FIG. 2. Once the top vertex has been found, execution unit 24 extracts segments of the polygon one at a time and, for each segment, subtracts the respective X and Y coordinates defining the bottom vertex of the segment from the X and Y coordinates defining the top vertex of the segment to determine $\Delta X$ and $\Delta Y$ for the segment. Execution unit 24 supplies YTOP (Y coordinate of the top vertex in the segment), XTOP (X top coordinate), XBOT (X bottom coordinate), $-\Delta Y$ and $-\Delta X$ along signal lines 28 to divider 26 for further processing. Lines 28 also carry T1, T0, REG, FIRST, LAST, $L/\overline{R}$, XREL and YREL signals, which will be explained later, and a SGREADY (segment ready) handshaking signal to communicate to divider 26 the presence of valid segment data at the inputs thereof. Divider 26 responds when not busy by activating LDDIV (load divider) handshaking line 30 to indicate to execution unit 24 that the segment data has been loaded into internal registers in the divider, whereupon execution unit 24 is enabled to extract the next segment.

Segments are extracted from the left and right sides of the polygon in a sequence which insures that, for any horizontal line intersecting the polygon, segment data for the two segments intersected by the line is available in the GMP for calculation of the left and right edge coordinates. Specifically, the sequence of segment extraction is as follows: After finding the top vertex, execution unit 24 extracts segments on both sides of the polygon from top to bottom, beginning with the top segment on the left side of the polygon, e.g., segment #7 in FIG. 2. Next, after data for segment #7 is loaded into divider 26, the top segment on the right side of the polygon is extracted, e.g., segment #1 in FIG. 2. After this, the bottom Y coordinates of the two previous segments are compared to determine the next segment to be extracted. The next segment extracted is the segment contiguous with the segment having the smaller bottom Y coordinate. For example, the third segment extracted from polygon in FIG. 2 is segment #6 because the bottom Y coordinate of segment #7, 15, is smaller than 30, the bottom Y coordinate of segment #1. The complete order of extraction for the sample polygon in FIG. 2 is as follows: #7, #1, #6, #5, #2, #3, #4.

The GMP and the associated circuits in the video processor operate under control of a 6.22 MHz clock signal which is asynchronous with the host processor clock. Memory cycles of the GMP execution units are four clock cycles in duration. Each shared RAM memory cycle takes two clock cycles, thus two memory cycles of the shared RAM occur during four clock cycles of the GMP, one of which is dedicated to the GMP and the other which is dedicated to the host processor according to the alternating allocation of shared RAM memory cycles already discussed. Each GMP memory cycle is divided into two halves, an address half cycle and a data half cycle, each of the half cycles being approximately equal to 320 nanoseconds (nsec).

Divider 26 calculates the slope of the segment extracted by execution unit 24 as an integer portion $\Delta X/\Delta Y$ and a remainder REM. Divider 26 supplies these values along with XBOT, XTOP, $-\Delta Y$, $\Delta XS$ (sign of $\Delta X$), FIRST, LAST, $L/\overline{R}$, and DIVRDY (divider ready) along lines 32 to left edge calculator 34L and right edge calculator 35. Divider 26 supplies YTOP to Y position calculator 36 on data lines 38 along with the T1, T0 and REG signals received from execution unit 24 for that segment. $L/\overline{R}$ is a control line which indicates to both edge calculators whether the segment data currently being output from divider 26 is from the left or right side of the polygon.

The left and right edge calculators calculate, respectively, the X coordinates for the left and right edges of the polygon for each horizontal line in the polygon given a segment definition from divider 26, starting with the top horizontal line. Three handshaking signals control the transfer data from divider 26 to left and right edge calculators 34L and 34R. Divider 26 generates a DIVRDY (divider ready) signal on one of lines 32 when a division operation is complete for a given segment and then waits for a response signal from the appropriate edge calculator. If the given segment is from the left side of the polygon, divider 26 supplies the slope data on output lines 32 when left edge calculator 34L responds by supplying a ECRDYL (edge calculator ready left) signal on control line 35L. Similarly, if the given segment is a right edge segment, data is output on lines 32 when an ECRDYR signal is received on control line 35R from right edge calculator 34R. The ECRDYR signal is also supplied to Y position calculator 36 for reasons which will be explained later.

When left edge calculator 34L has a valid edge coordinate in an output register, it activates a handshaking signal line (DATARDYL) in output lines 40L to indicate to horizontal line drawer 42 that data is ready at the left edge calculator outputs. Similarly, right edge calculator 34R generates a DATARDYR signal on one of lines 40R when right edge coordinate data is ready. If horizontal line drawer 42 is in condition to accept data for a new line, it loads the data into internal registers and responds with a handshaking signal LDLOAD (line drawer load) on line 44 to edge calculators 34L and 34L and Y position calculator 36. Upon receipt of this signal those calculators are ready to calculate the coordinates of the next horizontal line in the polygon.

Y position calculator 36 responds to the LDLOAD signal by incrementing an internal counter causing the counter to contain the Y coordinate of the next horizontal line to be drawn. Thus, one line at a time, X coordinates corresponding to the left and right edges of the polygon are supplied, respectively, to left window comparator 46L along data lines 48L and right window comparator 46R along data lines 48R, while the corresponding Y coordinate of the particular horizontal line is supplied to top/bottom window comparator 50 along data lines 52. Y position calculator 36 also supplies control signals to horizontal line drawer 42 along control lines 54.

Window comparators 46L, 46R and 50 are used to clip the horizontal line output of the edge calculators to the currently active clipping window. The output data resulting from the clipping operation is sent to the horizontal line drawer 42 along data output lines 56L, 56R and 58, respectively. Four registers in the window comparators, two in the top/bottom window comparator 50 and one each in comparator 46L and comparator 46R, define the four sides of a rectangular clipping window which can be placed anywhere on the screen. All points, lines and polygons drawn by the GMP are automatically clipped to the current window. The registers are under software control and can be modified at any time using a register loading instruction (LOAD) made available for this purpose.

The registers are loaded with data from the data buses 48L or 48R, data bus 48L being coupled to top/-bottom window comparator 50 for this purpose. Inhibit lines 60L, 60R and 62 are provided for signalling horizontal line drawer 42 to ignore a particular window comparator output if the output data should not be drawn, as when the data corresponds to an entire line which is outside the clipping window. If the left end point is left of the left edge of the clipping window, left window comparator 46L outputs the X coordinate of the left edge of the clipping window in place of the left edge X coordinate received at its input. Right window comparator 46R operates in an identical manner with respect to the right edge coordinates.

Horizontal line drawer 42 receives the left and right X coordinates and the Y coordinate from the window comparators and uses this data to generate address information for drawing a horizontal line into frame buffer 64 into the memory locations corresponding to the pixels between the left and right X coordinates at the Y position of interest.

The frame buffer is organized as a group of horizontal stripes, each n pixels wide where n is a power of 2. The frame buffer has the capability to set from one to n adjacent pixels in a horizontal stripe to the same value in one memory cycle. For a particular system, n depends upon the size, number and type of dynamics RAMs used to implement the frame buffer. For maximum throughput, the value of n must be maximized.

Each horizontal line is drawn one horizontal stripe at a time, starting at the left end of the line and proceeding to the right. A horizontal line may consist of one or more horizontal stripes. Depending on where the actual end points for the horizontal line are, all n pixels may not be drawn in the first and last stripes. If a horizontal line consists of more than two horizontal stripes, all n pixels will be drawn in the interior stripes and all n pixels may not be drawn in the first and last stripes.

The GMP's architecture permits the writing of data into frame buffer 64 in horizontal stripes of a predetermined number of pixels. In the preferred embodiment the GMP system is designed with a frame buffer having 32 pixels per stripe, although it will be understood that the invention is not so limited and that all concepts apply equally well to a system with a different number of pixels per stripe. However, it is preferred that the number be a power of two.

Each horizontal stripe is assigned a unique address in frame buffer 64, by which all pixels in a given stripe are addressed when an address data word is supplied to the address (ADD) input of frame buffer 64.

Horizontal line drawer 42 separates the five least significant bits (LSBs) from the X coordinate data received from left window comparator 60L and supplies the remaining bits of the X coordinate on address lines 66 to an address converter 68. Line drawer 42 also supplies the Y position data received from window comparator 50 to address comparator 68 along address lines 70 as a Y stripe address. For each stripe address, line drawer 42 supplies two data words to write enable generator 72 to identify the left and right end bits in the stripe which is to be written into frame buffer 64.

Address converter 68 converts the X and Y stripe addresses to an address that the frame buffer can use. In the preferred embodiment, the resolution of the display screen is 448 vertical pixels×576 horizontal pixels×4 bits per pixel, double buffered. Address converter 68 calculates a single frame buffer address based on the X and Y stripe addresses and on the basis of 18 stripes per line in the 576-pixel line of 32 pixels per stripe, as follows:

$$\text{FRAME BUFFER ADDRESS} = 18Y + X,$$

where X equals the X stripe address and Y equals the Y stripe address.

When data is to be written into frame buffer 64, a VIDEO CYCLE signal from CRT controller 76 on line 78 is low and selects the address from address converter 68 for transmission through multiplexer (MUX) 74 to the address input of frame buffer 64. The VIDEO CYCLE signal on line 78 is also supplied to line drawer 42. A high level on VIDEO CYCLE indicates that data may not be written into the frame buffer during the next memory cycle. Horizontal line drawer 42 waits until this condition is clear before producing an address for the next stripe.

Writing of data into desired ones of the 32 pixels which are addressed at a given time is controlled by write enable (WE) generator 72. Frame buffer 64 is arranged in 16K×4 RAMs, a total of 32 such RAM chips. Each RAM chip has its own write enable input, and write enable generator 72 correspondingly has 32 WE outputs. This structure allows the GMP to write data into the frame buffer for 1 to 32 horizontally adjacent pixels in one memory cycle. Write enable generator 72 activates only the WE lines which correspond to the pixels in frame buffer 64 that are to be modified in a given memory cycle. The ability to modify a large number of pixels in any one cycle while modifying only the pixels that need to be modified greatly increases the overall system speed.

Up to now, the means for selecting the pixels to be modified in the frame buffer has been described. The portion of the system which processes pixel color data will now be described.

The GMP supplies two pieces of information to external logic during each frame buffer memory cycle.

The first piece of information, supplied along address lines 66, defines which horizontal stripe is to be modified during that cycle, and the second, supplied to write enable generator 72, defines which pixels in that horizontal stripe are to be modified.

The data to frame buffer 64 comes from the address-/data bus through a two-level pipe line register consisting of data register 1 and data register 2. The data to the frame buffer, which includes the polygon color and translucency information, is not required to enter or exit the GMP, thus the GMP does not limit the number of bits per pixel in the system. Data is loaded into data registers 1 and 2 during specific periods of the GMP operation under control of output LD0 of execution unit 24 and output LD1 of line drawer 42. Execution unit 24 activates output LD0 when it recognizes the data portion of the instruction currently being executed. This causes the data word to be loaded into data register 1. Horizontal line drawer 42 activates output LD1 during the first memory cycle of the first line of a polygon to cause the polygon color word to be loaded into the second data pipe line register. The data in register 2 remains the same for the entire polygon being drawn into the frame buffer.

Once loaded into data register 2, the color word is also supplied to video shift register (VSR) 80. During a memory write cycle, VSR 80 may modify the data according to dither and read-modify-write control signals, and supplies the processed data to the data (D) port of frame buffer 64. During a memory read cycle, data for 32 pixels is loaded in parallel into VSR 80 from the data port of frame buffer 64 and serially shifted out to color palette RAM 82 which drives the red, green and blue D/A converters 84 which in turn control the three electron guns in CRT 86. CRT controller 76 supplies the necessary horizontal and vertical synchronization signals (HSYN and VSYN) to CRT 86 in a conventional manner and supplies read addresses to the frame buffer through MUX 74. In the preferred embodiment the display is refreshed at 30 frames per second. The serial stream of pixel values from VSR 80 are fed to the address inputs of color palette RAM 82.

The graphics microprocessor, shown in broken lines in FIG. 3, is preferably implemented in a pair of 40-pin very-large-scale integrated (VLSI) circuits. One chip contains execution unit 24, and divider 26. The other chip contains calculators 34L, 34R and 36, window comparators 46L, 46R and 50, and horizontal line drawer 42.

III. EXECUTION UNIT AND SEGMENT EXTRACTOR

The GMP's instruction set allows the programmer to easily manipulate graphical primitives. There is no need for the programmer to be concerned with repetitive tasks usually required when programming graphics systems, such as calculating the actual frame buffer addresses of pixels to be modified, calculating difference parameters defining lines to be drawn, and searching the frame buffer for polygon edges to do polygon fills. Execution unit 24 controls the execution of the GMP instruction set, which is shown below.

INSTRUCTION SET

Graphics Primitive Instructions

| Mnemonic | Description |
|---|---|
| PNTDRW (DATA, Y, X) | Point draw |
| LDRW (DATA, Y1, X1, Y2, X2) | Line draw |
| PDRW (N, DATA, Y1, X1, . . . Y(N+1), X(N+1) | Polygon draw |

Register Loading Instructions

| Mnemonic | Description |
|---|---|
| LOAD (REG#, DATA) | Load border register |
| S32B | Select 32-bit mode |
| S16B | Select 16-bit mode |

Program Control Instructions

| Mnemonic | Description |
|---|---|
| JUMP (ADDRESS) | Jump unconditional |
| JSR (YREL, XREL, ADDRESS) | Jump to subroutine |
| JSRC (DATA, YREL, XREL, ADDRESS) | Jump to subroutine, color |
| RTS | Return from subroutine |
| COMP | Stop |

The preferred embodiment employs a sixteen-bit format for each instruction word, as shown below.

PDRW

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | T1 | T0 | 0 | 0 | 0 | 0 | N | | | | | | | |
| x | x | x | T/D | LEVEL | | | | DATAH | | | | DATAL | | | |
| x | x | x | x | Y1 | | | | | | | | | | | |
| x | x | x | x | X1 | | | | | | | | | | | |
| . | . | . | . | . | . | . | . | . | . | . | . | . | . | . | . |
| . | . | . | . | . | . | . | . | . | . | . | . | . | . | . | . |
| . | . | . | . | . | . | . | . | . | . | . | . | . | . | . | . |
| x | x | x | x | Y(N+1) | | | | | | | | | | | |
| x | x | x | x | X(N+1) | | | | | | | | | | | |

A PDRW instruction causes the GMP to draw a filled polygon into the frame buffer.

N—Number of vertices in the polygon minus 1, $0 \leqq N \leqq 255$. A 1-vertex polygon is a single pixel and a 2-vertex polygon is a line. Although separate mnemonics are illustrated above for PNTDRW and LDRW instructions, the PDRW instruction is actually used for points with N=0, and for lines with N=1.

T/D, LEVEL, DATAH, DATAL—If T/D is 0 the polygon will be completely filled in and the dithering circuit will be used to set part of the pixels to DATAL and the remainder to DATAH. The fraction of the pixels set to DATAL will be (16-LEVEL)/16. If T/D is 1 the transparency circuit will be used to set a fraction of the pixels in the polygon to DATAL. The remainder of the pixels will not be modified. The fraction of pixels that are set to DATAL will be (16-LEVEL)/16. If LEVEL=0 all of the pixels in the polygon will be set to DATAL. In this case DATAH and T/D are don't cares.

T1, T0—Type of read-modify-write to be used when drawing the polygon. If both T1 and T1 are zeros then read-modify-write is not to be used. In this case the data written into the frame buffer will not be a function of the data already in the frame buffer. If T1 or T0 is one then a read-modify-write is to be used and T1 and T0 determine the type of logic function used for the modification.

LOAD (REG#, DATA)

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | 1 | 0 | 0 | 0 | 0 | 0 | 0 | 0 | 0 | 0 | 0 | 0 |
| x | x | x | x | x | x | x | x | x | x | x | x | x | x | x | x |
| x | x | x | x | x | x | x | x | x | x | x | x | x | REG# | | |
| x | x | x | x | DATA | | | | | | | | | | | |

Load register #REG with DATA

REG# Function 0 pixel address of top clipping border (section VII)
1 pixel address of bottom clipping border (section VII)
2 pixel address of left clipping border (section VII)
3 pixel address of right clipping border (section VII)

S32B

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | 1 | 1 | 1 | 0 | x | x | x | x | x | x | x | x |

Switch the GMP into 32-bit mode. When in 32-bit mode all DATA words in PDRW and JSRC instructions must be 32 bits rather than 16 bits. After power-on reset the GMP enters 16-bit mode.

S16B

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | 0 | 1 | 1 | 0 | x | x | x | x | x | x | x | x |

Switch the GMP into 16-bit mode. When in 16-bit mode all DATA words in PDRW and JSRC instructions must be 16 bits rather than 32 bits.

JUMP

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | x | 0 | 0 | 1 | x | x | x | x | x | x | x | x |
| ADDRESS | | | | | | | | | | | | | | | |

Jump to address ADDRESS in instruction memory. ADDRESS is a word address, therefore it can be odd or even.

JSR

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | x | 1 | 0 | 0 | x | x | x | x | x | x | x | x |
| x | x | x | x | YREL | | | | | | | | | | | |
| x | x | x | x | XREL | | | | | | | | | | | |
| ADDRESS | | | | | | | | | | | | | | | |

Jump to the subroutine at address ADDRESS in instruction memory. ADDRESS is a word address, therefore it can be odd or even. Set the Y relative register and X relative register to YREL and XREL respectively. All polygons that are drawn after this instruction is executed and before a RTS instruction is executed will be drawn at coordinates offset by YREL and XREL. Only one level of nesting is allowed so a RTS instruction must be executed before another JSR or JSRC instruction is executed.

JSRC

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | x | 1 | 0 | 1 | x | x | x | x | x | x | x | x |
| DATA | | | | | | | | | | | | | | | |
| x | x | x | x | YREL | | | | | | | | | | | |
| x | x | x | x | XREL | | | | | | | | | | | |
| ADDRESS | | | | | | | | | | | | | | | |

Jump to subroutine at address ADDRESS in instruction memory. ADDRESS is a word address, therefore it can be odd or even. Set the Y relative register and X relative register to YREL and XREL respectively. All polygons that are drawn after this instruction is executed and before a RTS instruction is executed will be drawn at coordinates offset by YREL and XREL and will use the value for DATA specified in this instruction rather than the values specified in the Polygon Draw instruction. If the GMP is in 32-bit mode DATA will be a 32-bit number and an extra word must be reserved for it in the instruction sequence. Only one level of nesting is allowed so a RTS instruction must be executed before another JSR or JSRC instruction is executed.

RTS

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | x | 0 | 1 | 1 | x | x | x | x | x | x | x | x |

Return from subroutine and set the Y relative and X relative registers to 0. After this instruction is executed all polygons will be drawn at the absolute coordinates specified in the instruction.

COMP

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| x | x | x | x | x | 0 | 1 | 0 | x | x | x | x | x | x | x | x |

Stop executing instructions and wait for the GMP to be started again by activation of its START input (not shown). The START line and a COMP line serve as handshaking signals lines between the GMP and the host processor.

Execution unit 24 communicates with shared RAM interface 16 through input register 100 and address register 102 connected to the address/data bus. The operation of these circuits is controlled by control circuit 104, which is a synchronous state machine that can change state once every four system clock cycles, i.e., once every shared RAM memory cycle. Each memory cycle is divided into two halves, the first half being an address half cycle and the second half being a data half cycle. During the address half cycle, adder 106 is used to calculate an address for accessing the shared RAM. The address is latched into address register 102 at the end of the address half cycle, and it drives the shared RAM during the next half cycle.

At the beginning of the data half cycle the data read from the shared RAM memory location with the address specified by address register 102 during the previous shared RAM memory cycle is latched into the input register 100. During the remainder of the data half cycle adder 106 is used to calculate the difference between this input data and the data stored in one of the registers that drive the A input of adder 106 through A multiplexer (MUX) 108.

In the course of executing instructions, data half cycles occur in which execution unit 24 does not have to receive valid data from the shared RAM. During the address half cycle of the previous shared RAM memory cycle the refresh (RFSH) signal is activated causing the contents of refresh counter 110 to be loaded into address register 102 though the B input of RFSH MUX 112. The B input of MUX 112 is selected by the RFSH signal at the multiplexer select input. A refresh feature is provided so the shared RAM can be implemented with low-cost dynamic RAMs that require periodic refreshing. At the end of the address half cycle, refresh counter 110 is incrimented so as to provide an address for a different location in the shared RAM to step through all shared RAM memory locations.

Base register 114 acts as the program counter for the GMP. When the GMP is reset, base register 114 is reset to zero and the first instruction executed is at address zero in shared RAM 14. The contents of base register 114 are incremented during each address half cycle. Control circuit 104 selects base register 114 through A MUX 108 connected to the A input of adder 106 and simultaneously supplies a logical "1" carry-in signal to the carry-in (CI) input of adder 106. Control circuit 104 selects left U/D counter 121 through B MUX 136 for application to the B input of adder 106. U/D counter 121, the function of which will be described later, contains zero at this time. The resulting output of the adder is the contents of base register 114 plus one. This value is sent through MUX 12 and address register 102 to shared RAM interface 16. It is then read back into the GMP through input register 100 and stored in base register 114.

During a PDRW instruction control section 104 loads bits 11, 12 and 13 of the operation (opcode) code word into RMW input register 116 and the eight least significant bits (LSBs) of the opcode word into segment down counter 118 and segment register 120. The data in bits 0 through 7 is equal to the number of vertices in the polygon minus 1. Left up/down (U/D) counter 121 and right U/D counter 122 each have a variable modulus which is set equal to the number of segments in the polygon such that, if the contents of a counter is equal to the contents of segment register 120 and it is instructed to count up, its value will be set to zero. Conversely, if the counter contains zero and it is instructed to count down, its value will be set to the contents of segment register 120.

In the next memory cycle for the PDRW instruction, control section 104 activates the LD0 output to load the data word into data register 1. At this time, control section 104 also selects, through A MUX 108, YREL input register 124 and selects YREL output register 126 to load the contents of the YREL input register into the YREL output register. Control circuit 104 then feeds the contents of XREL input register 128 through A MUX 108 to XREL output register 130 in a similar fashion, and further loads the contents of RMW input register 116 into RMW output register 132. The T0 and T1 outputs of RMW output register 132 are from bits 12 and 13 of the opcode word in the PDRW instruction, respectively, while the REG bit is bit 11 in the opcode word.

Execution unit 24 then proceeds to scan the list of vertices in the shared RAM for the polygon of interest to determine which vertex is at the top of the polygon. This is accomplished using base register 114, left and right U/D counters 121 and 122, and left YTOP register 134. Base register 114 is incremented so that it points to the Y coordinate of the first vertex in the polygon, and the U/D counters are reset to zero under control of control circuit 104. A MUX 108 and B MUX 136 are set during address cycles so the address to the shared RAM is the sum of the contents of base register 114 and of Left U/D counter 121. In this manner, the Y coordinate of all the vertices in the polygon can be scanned in clockwise order by incrementing U/D counter 121 and in counterclockwise order by decrementing that counter.

During data cycles A MUX 108 and B MUX 136 are set to select, respectively, the outputs of YTOP register 134 and bus inverter 138. Inverter 138 is a 12-bit inverter the output of which is the ones complement of the data word from input register 100. The ones complement is converted to twos complement by control circuit 104 supplying a high carry-in signal to the CI input of adder 106. The output of the adder thus equals the contents of YTOP register 134 minus that of input register 100. Since the Y coordinates of the vertices are being scanned, input register 100 will contain the Y coordinate of a vertex. At the end of a data cycle, the contents of input register 100 are loaded into YTOP register 134 to store the Y coordinate of the previous vertex there. Thus, the output of adder 106 equals the difference between the Y coordinates ($\Delta Y$) of adjacent vertices of a polygon. At the end of data cycles, the output of adder 106 is loaded into $-\Delta Y$ register 140.

Control section 104 examines the MSB, the sign bit, of $-\Delta Y$ register 140 to determine if the scan direction is up or down. If it is moving up, the direction is correct and it will continue. However, if it is moving down, it begins scanning in the opposite direction. Scanning continues in this manner until control section 104 determines that it has begun scanning down, at which time it knows that it has just passed the top vertex of the polygon. At this point, counters 121 and 122 are left in a state such that, when added to the contents of base register 114, the result points to the Y coordinate of the top vertex of the polygon.

Once the top vertex has been found, execution unit 24 begins extracting segments on both sides of the polygon. Since the top vertex is part of the first segment on both the left and right sides of the polygon, its Y coordinate is read in and stored in left YTOP register 134 and right YTOP register 142, and its X coordinate is read in and stored in left XTOP register 144 and right XTOP register 146. Left U/D counter 121 is then decremented to provide an address for the bottom vertex of the first segment on the left side of the polygon. The Y coordinate of that vertex is loaded into input register 100 at the beginning of a data half cycle. During the data half cycle, A MUX 108, B MUX 136 and the CI input of adder 106 are set so that the output of the adder is equal to the contents of left YTOP register 134 minus those of input register 100. or $-\Delta X$. At the end of the data half cycle the output of the adder is loaded into $-\Delta Y$ register 140, the output of A MUX 108 is loaded into YTOP register 148, and the contents of input register 100 are loaded into left YTOP register 134. It should be noted here that, since Y values always increase in the downward direction and since that is the direction of movement during the segment extraction process, the value loaded into $-\Delta Y$ register 140 will always be zero or a negative number.

At the beginning of the next data half cycle the X coordinate of the bottom vertex of the first segment on the left side of the polygon will be loaded into input register 100, and A MUX 108 and B MUX 136 will be set so that the output of adder 106 is equal to the contents of left XTOP register 144 minus that of input register 100. At the end of the data half cycle, the output of adder 106 is loaded into $-\Delta X$ register 150, the output of A MUX 108 is loaded into XTOP register 152, the output of B MUX 136 is complemented in bus inverter 154 and loaded into XBOT register 156, and the contents of input register 100 are loaded into left XTOP register 144.

At this time, all of the information describing the first segment is stored in the output registers of execution unit 24, and control section 104 activates the segment ready (SGREADY) handshaking output to indicate to divider 26 that a segment is ready for loading into the divider. Execution unit 24 then waits for a load divider (LDDIV) handshaking signal from divider 26 indicating that the divider is ready to load the data contained in the output registers. Control section 104 also activates the FIRST output line to indicate that the current segment information is for the first segment of the polygon, and supplies a high output on the $L/\overline{R}$ output line indicating the segment is on the left side of the polygon. Similarly, LAST is activated for the last segment, and $L/\overline{R}$ is low for right side segments.

When LDDIV goes high, control circuit 104 begins to extract the next segment of a polygon. As stated previously, the second segment extracted is the top segment on the right side. This segment is extracted in the same fashion as the first segment except that right U/D counter 122 is used rather than left U/D counter 121, and counter 122 will be incremented rather than decremented. Also, right YTOP register 142 and right XTOP register 146 will be used rather than left YTOP register 134 and left XTOP register 144.

The next segment to be extracted is determined by the contents of left YTOP register 134 and right YTOP register 142. At this point, these registers contain the Y coordinates of the bottom vertices of the last segment extracted on each side of the polygon. If the contents of left YTOP register 134 are less than the contents of right YTOP register 142, i.e., the bottom point of the previous left side segment is above that of the previous right side segment, the next segment extracted will be on the left side. Otherwise, the next segment will be on the right side. This same test is used when extracting all of the remaining segments on the polygon.

Segment down counter 118 is decremented after each segment is extracted. When the counter reaches 0, the last segment is being extracted. To proceed to the next instruction in the shared RAM the contents of segment register 120 are added to the contents of base register 114 in adder 106, the result incremented by two and stored back in base register 114. Base register 114 then points to the next instruction.

During JUMP instructions, the jump address is read from the shared RAM into input register 100 and then stored in base register 114. JSR and JSRC are useful for drawing polygonally defined alphanumeric characters. Each such character may be defined in its own subroutine in which the character is positioned at screen coordinates (0,0). A character so defined may be drawn simply be executing a JSR or JSRC instruction in which XREL and YREL specify the desired screen location for the character. The color for the character may be specified in the main program using the JSRC instruction, whereas if the color of the character will always be the same, the JSR instruction is used and the color is specified in the subroutine.

During JSR instructions the YREL and XREL values are read into input register 100 and stored in YREL input register 124 and XREL input register 128, respectively. The ADDRESS value in the JSRC instruction is read and stored in base register 114. The address of the next instruction, which is the return address from the subroutine, is then stored in stack register 158.

During JSRC instructions, control section 104 activates its LDO output to laod the DATA word in the instruction into data register 1. As for the JSR instruction, the YREL and XREL values are read into input register 100 and stored in YREL and XREL input registers 124 and 128, respectively, and the ADDRESS value is read in and stored in base register 114. Similarly, the return address from the subroutine is stored in stack register 158. A DISABLE flip-flop in control section 104 is set which forces the LDO output to remain inactive during future PDRW instructions. All polygons that are drawn after the execution of a JSRC instruction will use the DATA word in the JSRC instruction rather than the DATA word in the PDRW instruction.

The RTS instruction is used to return from a subroutine. During execution of this instruction, A multiplexer 108 is set to select stack register 158 so that the return address stored in that register can be sent through adder 106 and MUX 112 to address register 102. This value is then read by input register 100 and loaded into base register 114 causing base register 114 to point to the instruction following the last JSR or JSRC instruction.

The LOAD instruction is very similar to a 1-vertex PDRW instruction. Bit 11 of the opcode word is set to a "1", whereas in the PDRW instruction it is set to "0". A "1" value in bit 11 causes the REG bit output from RMW output register 132 to be set during a LDREG instruction, which forces succeeding sections of the GMP to treat the data as a register load rather than as a polygon draw.

IV. DIVIDER

Figure 5:
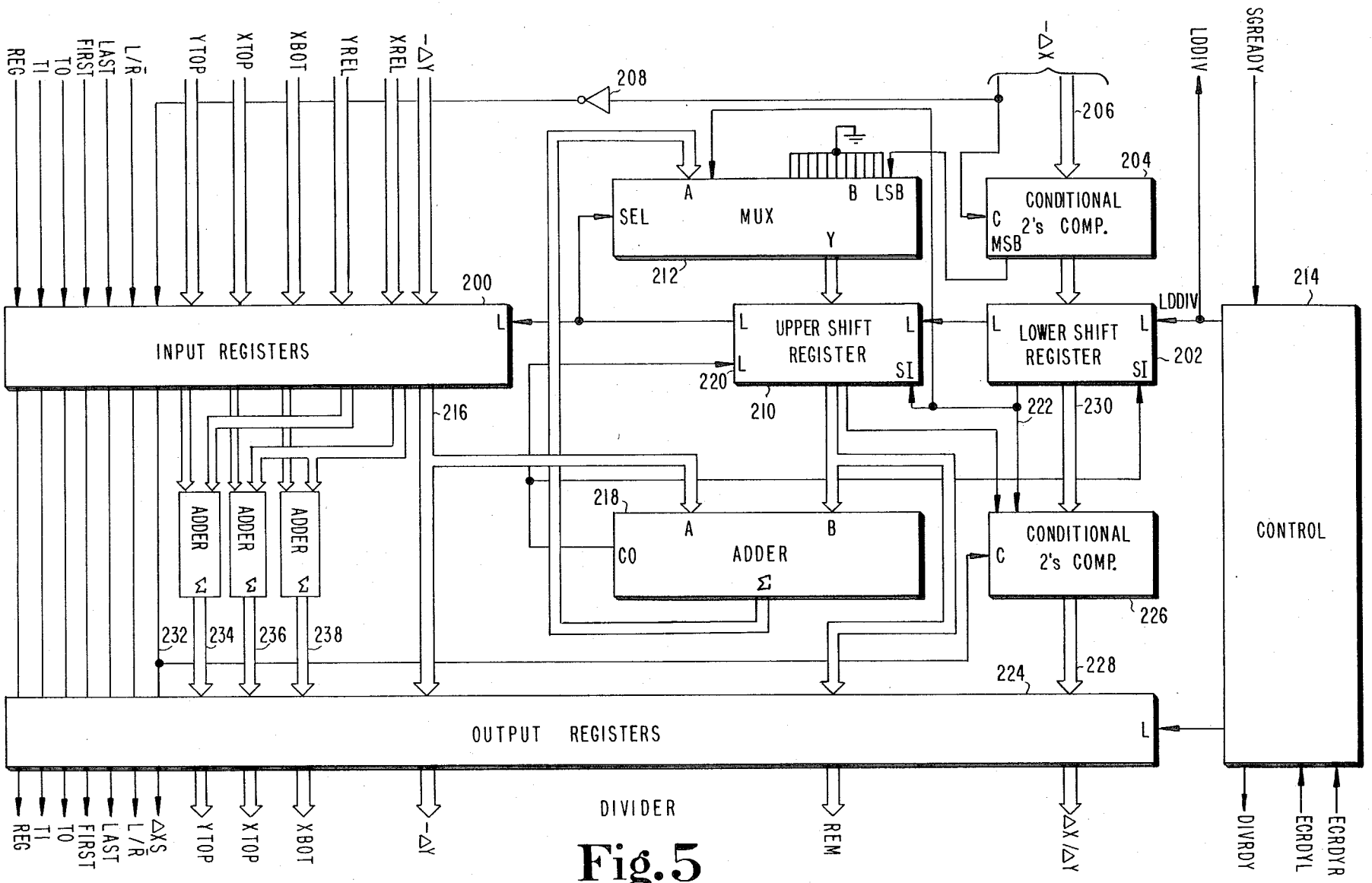
FIG. 5 is a diagram, partially in block diagram form and partially in schematic form, showing the divider of FIG. 3.
Figure 6:
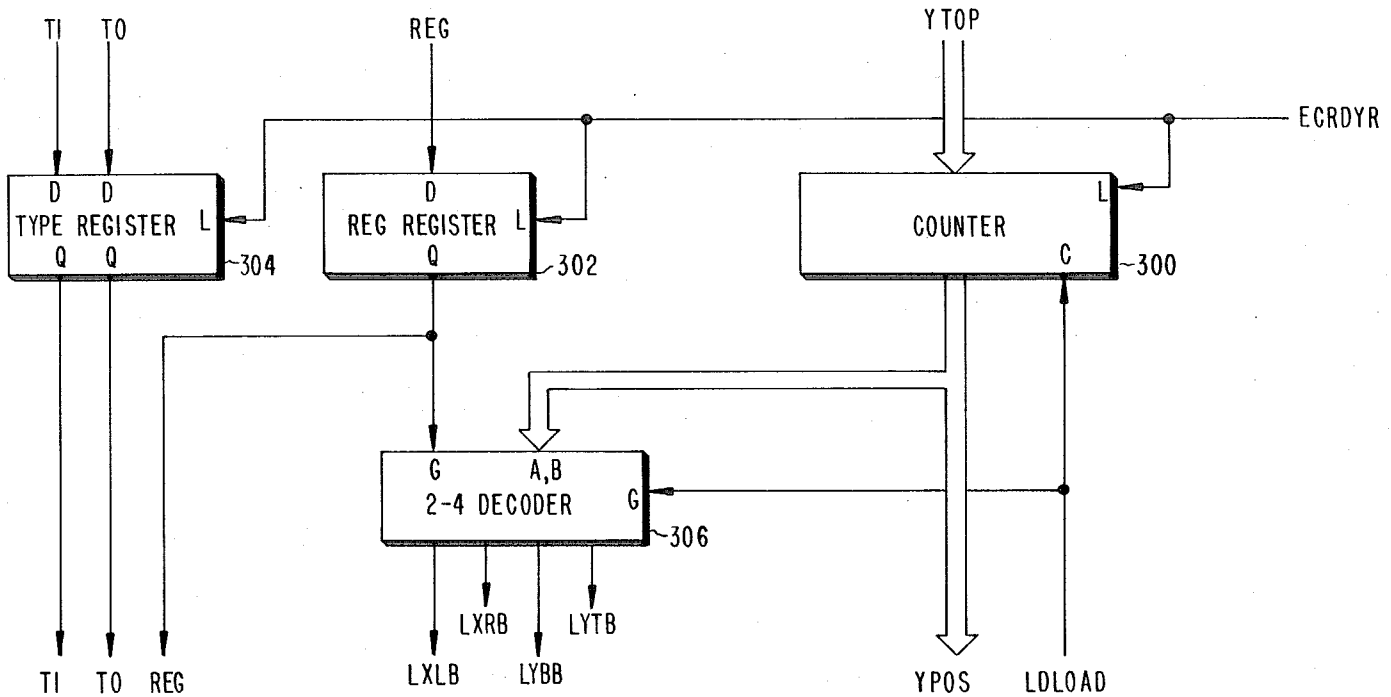
FIG. 6 is a block diagram of the Y position calculator of FIG. 3.

Referring now to FIG. 5, divider 26 calculates the slope of the segment extracted by execution unit 24 in terms of an integer quotient, $\Delta X/\Delta Y$, and a remainder REM. Divider 26 also adds YREL and XREL to the coordinates of the vertices defining the segment. Input lines 28 shown in FIG. 3 include the following signals which are supplied by execution unit 24 to divider 26; SGREADY, T1, T0, REG, FIRST, LAST, $L/\overline{R}$, XREL, YREL, YTOP, XBOT, XTOP, $-\Delta Y$, $-\Delta X$. Divider 26 supplies the LDDIV signal to execution unit 24 on line 30 (FIG. 3) in response to a SGREADY signal if divider 26 is not busy doing a division operation. The LDDIV signal indicates to execution unit 24 that the segment data supplied on lines 28 has been loaded into input registers 200 and lower shift register 202 so that execution unit 24 is free to extract the next segment of the polygon. Since the divider circuitry shown in FIG. 5 operates only with positive numerators, $-\Delta X$ is fed into conditional twos complement circuit 204 to obtain $|\Delta X|$, the absolute value of $\Delta X$. $-\Delta X$ is a 12-bit data word, the 11 LSBs of which are supplied to twos complement circuit 204 on lines 206. The MSB, which is the sign bit, is supplied to the control (C) input of twos complement circuit 204 to indicate to that circuit whether the input data needs to be complemented to convert it to a positive number. The sign bit is also inverted in inverter 208 and latched into input registers 200 for sign conversion of the calculated slope, if necessary, as will be described. The lower 10 bits of $|\Delta X|$ are loaded into shift register 202 while the MSB of $|\Delta X|$ is loaded into the LSB of upper shift register 210 through the B input of multiplexer 212. Note that, since the 11 MSBs of the B input to MUX 212 are tied to ground, the 12-bit data word which is loaded into shift register 210 has a zero value in its 11 MSBs.

Control circuit 214 controls the operation of divider 26, initiating a divider load operation by sending an LDDIV signal to one load (L) input of lower shift register 202 and therethrough to upper shift register 210 and inputs registers 200 which have L inputs and outputs in cascade with the L output of lower shift register 202. In this manner, the data from execution unit 24 is loaded simultaneously into the input and shift registers. As shown in FIG. 5, the LDDIV signal is also sent out of divider 26 as a handshaking signal to execution unit 24.

Divider 26 employs a conditional subtraction-shift division algorithm requiring 11 clock cycles, one clock cycle for each bit of $|\Delta X|$. During each clock cycle, $\Delta Y$ is subtracted from the data in upper shift register 210. Subtraction of $\Delta Y$ is accomplished by adding $-\Delta Y$, which is a 12-bit word coupled along lines 216 to the A input of adder 218, to the 12-bit output word from shift register 210 appearing at the B input of adder 218.

The selector (SEL) input of multiplexer 212 is set by control circuit 214 to select the B input for initial loading of data into shift register 210. Once that initial data is loaded, the SEL input of multiplexer 212 is changed to select the A input for the remainder of the division operation. Thus, the result of the subtraction performed by adder 218 appears at the input of upper shift register 210 into which the data is loaded depending on the carry-out (CO) bit level of adder 218. If the 12-bit word in shift register 210 is greater in value than $\Delta Y$, the addition of that value to $-\Delta Y$ will result in a positive number out of adder 218 and a carry out value of "1" indicative of the positive result. Since the number resulting from the subtraction is a positive number, the result is loaded into upper shift register 210 by the CO output of adder 218 driving L input 220 high. The high carry-out bit from adder 218 is shifted into the shift-in (SI) input of lower shift register 202 at this time, all the other bits in shift register 202 shifting left one bit. The MSB of lower shift register 202 is shifted out on line 222 which is coupled to the LSB input of the A input of multiplexer 212, through which it is loaded into the LSB of upper shift register 210. Note that the output of adder 218 is 11 bits wide; these 11 bits are the 11 LSBs of the sum of the A and B input values.

If the carry-out of adder 218 is a zero, the results of the subtraction are ignored because the data in the upper shift register 210 is too small to produce a positive result. In this case, both shift registers shift left one bit and the "zero" value out of the carry-out output of adder 218 is shifted into the LSB of lower shift register 202 through its shift-in input. The data shifting out of lower shift register 210 appears on line 222 from which it is coupled to the shift-in input of upper shift register 210.

After 11 clock cycles of such conditional subtraction and shifting, the integer portion of $\Delta X/\Delta Y$ resides in the 10 bits of lower shift register 202 and the LSB of upper shift register 210. The remainder generated by the division resides in the upper 11 bits of upper shift register 210, and is always a positive number.

During the 12th clock cycle, if the slope data from the previous division has been read by the appropriate edge calculator, control section 214 activates the DIVRDY (divider ready) output to indicate to the edge calculators that the divider is ready to supply output data for a particular segment and generates a load (L) signal to load output registers 224. If the slope data has not been read, the divider remains idle, neither loading the output registers nor reading in new data into its input registers, until the data is read. The DIVRDY signal is supplied to both edge calculators on one of output lines 32 (FIG. 3). Three handshaking lines control the transfer of data from divider 26 to left and right edge calculators 34L and 34R. The ECRDYL and ECRDYR (edge calculator ready left and right, respectively) inputs to the control circuit 214 indicate that the left or right edge calculator is reading the contents of the output register 224 so the results of the next division can be loaded into the output register. Divider 26 generates a DIVRDY (divider ready) signal on one of lines 32 when a division operation is complete for a given segment and then waits for a response signal from the appropriate edge calculator. If the given segment is from the left side of the polygon, divider 26 supplies the slope data output on lines 32 and left edge calculator 34L responds by supplying a ECRDYL (edge calculator ready left) signal on control line 35L. Similarly, if the given segment is a right edge segment, data is output on lines 32 and a ECRDYR signal is received on control line 35R from right edge calculator 34R. The ECRDYR signal is also supplied to Y position calculator 36 for reasons which will be explained later.

Conditional twos complement circuit 226 supplies a 12-bit output data word on lines 228 to a $\Delta X/\Delta Y$ output register within output registers 224. The 10-bit data word in lower shift register 202 is supplied to the input of conditional twos complement circuit 226, nine bits along lines 230 and the MSB along line 222. The LSB of upper shift register 210, in addition to being supplied to the B input of adder 218, is supplied to the MSB input of twos complement circuit 226. The twos complement of $\Delta X/\Delta Y$ will be generated depending on the sign bit of the $-\Delta X$ input to divider 26, which sign bit, it will be recalled, was initially inverted and stored in input registers 200 at the beginning of the division operation. Input registers 200 act as a buffer register for the input data and therefore supply that same data out unchanged. Thus, the inverted sign bit appears on line 232 from which it is coupled to the C input of twos complement circuit 226. Since $\Delta Y$ is always a positive number, the sign bit of $\Delta Y$ determines the sign of the slope. If $\Delta X$ is a positive number, the sign bit of $-\Delta X$ is a "1", therefore the C input to twos complement circuit 226 is a "0" which causes that circuit not to generate the twos complement of $\Delta X/\Delta Y$. Conversely, for a negative value of $\Delta X$, the twos complement of $\Delta X/\Delta Y$ will be generated.

It will be appreciated from this explanation that twos complement circuits 204 and 226 cooperate to produce a slope having the same sign as $\Delta X$: If $\Delta X$ is a positive number, the sign bit of $-\Delta X$ causes twos complement circuit 204 to generate the twos complement of $-\Delta X$ and causes twos complement circuit 226 to pass its input data through to output lines 228 without generating the twos complement of the slope. Conversely, if $\Delta X$ is a negative number, a sign conversion is not performed by twos complement circuit 204 but is performed by twos complement circuit 226.

Adders 234, 236 and 238 are provided in divider 26 to add XREL to XBOT and XTOP, and to add YREL to YTOP generating the absolute coordinates for the vertices defining the segment. The results of these additions are loaded into output registers 224 at the same time as the results of the division operation. The signals $L/\overline{R}$, FIRST, LAST, REG, T0, T1 and $-\Delta Y$ are not modified by divider 26, but are simply delayed and passed on through output registers 224 when the division is complete. FIRST, LAST, $L/\overline{R}$, XBOT, XTOP, $-\Delta Y$, $\Delta XS$, $\Delta X/\Delta Y$, REM and DIVRDY are supplied to edge calculators 34L and 34R (lines 32 in FIG. 3), while T1, T0, REG and YTOP are fed to Y position calculator 36 (lines 38 in FIG. 3).

V. Y POSITION CALCULATOR

New segment information is loaded into Y position calculator 36, as well as right edge calculator 34R, when ECRDYR is active. Divider 26 supplies YTOP, REG, T1 and T0 on lines 38 (FIG. 3). YTOP, the Y coordinate of the top vertex in the segment, is loaded into counter 300 while the REG bit is loaded into REG register 302 and T1 and T0 are loaded into type register 304. T1 and T0 define the type of READ-MODIFY-WRITE to be performed on the current polygon. The REG bit identifies whether the current instruction is a PDRW or LOAD instruction: for PDRW instructions, the REG bit is a "0", and for LOAD instructions it is a "1". It will be recalled that REG, T0 and T1 represent the values of bits 11, 12 and 13 in the opcode word, respectively.

After preloading counter 300 with the Y coordinate of the top horizontal line in the segment, new values of YPOS are calculated by incrementing counter 300. Counter 300 is incremented by one each time LDLOAD, which is connected to the clock (C) input of counter 300, goes high, which occurs each time a horizontal line definition is loaded by horizontal line drawer 42. This causes counter 300 to contain the Y coordinate YPOS of the next horizontal line to be drawn.

The values of REG, T0 and T1 which are latched into registers 302 and 304, are supplied direct to the output of Y position calculator 36 and therefrom to horizontal line drawer 42 along lines 54 (FIG. 3).

2–4 decoder 306 is provided to generate control signals for the window comparators to indicate which border register is to be loaded during the execution of a LOAD instruction. If the current instruction is a LOAD instruction, a "1" is contained in REG register 302, the Q output of which drives one of the enable inputs G of decoder 306. The LDLOAD line drives the other enable input G of decoder 306 whereby, when LDLOAD goes high during the execution of a LOAD instruction, decoder 306 is enabled and one of its four outputs LXLB, LXRB, LYBB and LYTB goes high. The high output will be determined by the two bits at the A and B control inputs of decoder 306. Those two bits are the two LSBs of the YPOS data word, which for this instruction contains only the number of the register to be loaded, as can be seen from examination of the third word in the LOAD instruction in the instruction set. Outputs LXLB and LXRB are coupled to left and right window comparators 46L and 46R, while outputs LYBB and LYTB are coupled to top/bottom window comparator 50 along with YPOS on lines 52.

VI. LEFT AND RIGHT EDGE CALCULATORS

Figure 7:
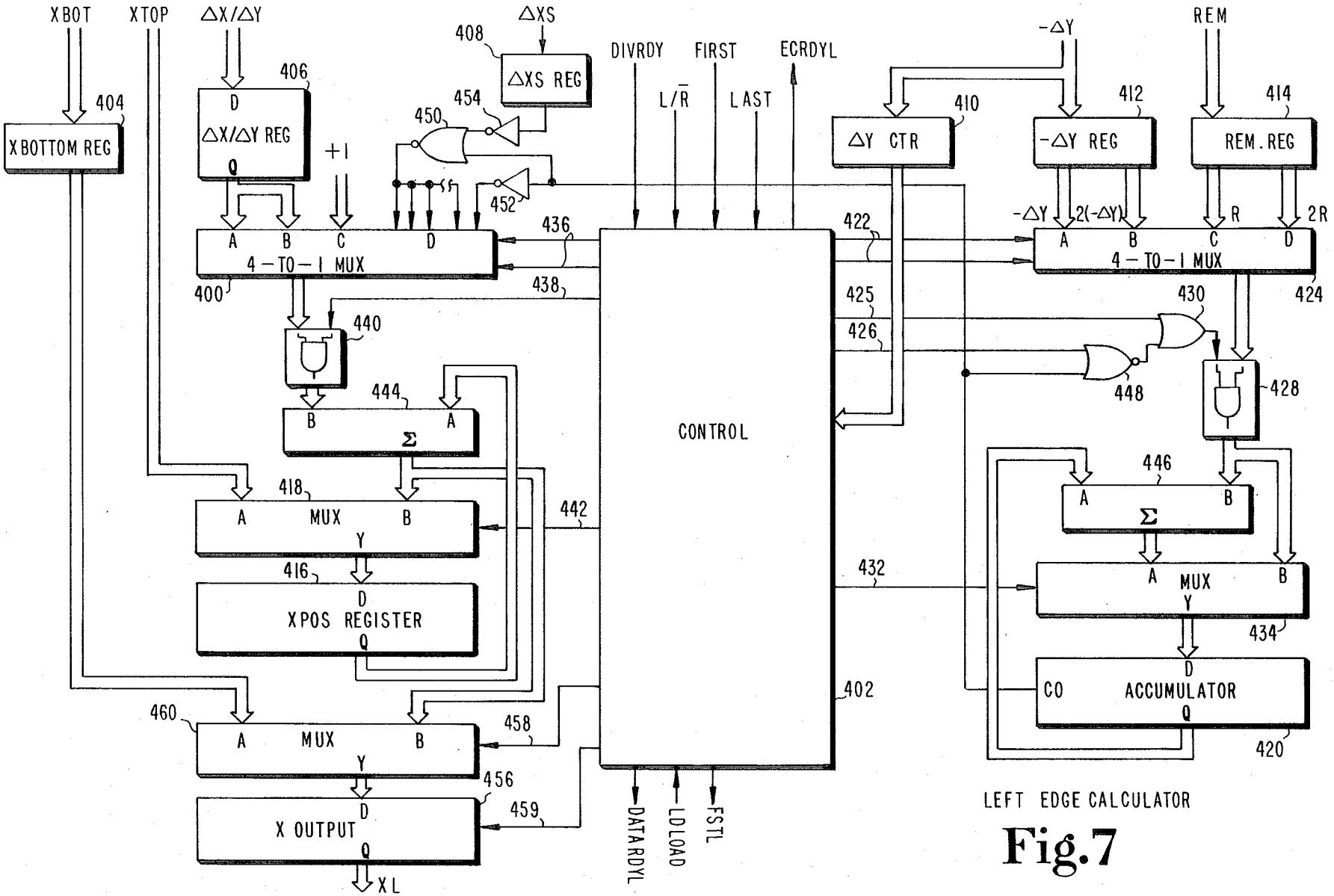
FIG. 7 is a block diagram of the left edge calculator of FIG. 3.

Both edge calculators will be described with reference to FIG. 7 which shows left edge calculator 34L partly in block diagram form and partly in schematic form. The two edge calculators are identical except for the C input to 4-to-1 multiplexer 400. In right edge calculator 34R, the C input is set to a value of $-1$ as opposed to $+1$ for edge calculator 34L. $+1$ is added to the left edge X coordinate in certain situations, as will be described. Left edge calculator 34L calculates the X coordinate for the left edge of the polygon and right edge calculator 34R calculates the right edge X coordinate. Except as noted, the ensuing description of left edge calculator 34L applies equally to right edge calculator 34R.

For all segments, when ECRDYL is activated, the segment definition data is loaded under control of control circuit 402 into the input registers of the edge calculator: XBOT is loaded into X BOTTOM register 404, $\Delta X/\Delta Y$ is loaded into $\Delta X/\Delta Y$ register 406, $\Delta XS$ is loaded into $\Delta XS$ register 408, $-\Delta Y$ is loaded into $\Delta Y$ counter 410 and $-\Delta Y$ register 412, and the remainder REM is loaded into REM register 414. All 12 bits of $\Delta X/\Delta Y$ are supplied by register 406 to the A input of MUX 400, and $(\Delta X/\Delta Y)/2$ is supplied to the B input ($\Delta X/\Delta Y$ is shifted one bit to the right, with the MSB, the sign bit, also being coupled to the MSB of the B input). The LSB of $\Delta X/\Delta Y$ is also supplied to control circuit 402 (line not shown). Similarly, $2(-\Delta Y)$, the B input to MUX 424, is generated by shifting $-\Delta Y$ one bit to the left, and two times the remainder REM (2R) is generated by shifting the contents of REM register 414 one bit to the left.

Edge calculator 34L performs one of three different algorithms depending upon the slope of the segment. By so doing the edge calculator is able to calculate the X coordinates required to depict the ideal line between any two segment vertices regardless of the segment slope. Each of the three algorithms will be described in detail below.

Control circuit 402 tests the contents of $\Delta X/\Delta Y$ register 406 (lines not shown) to determine the algorithm to be performed on the segment data stored in the input registers. The truth table for the test is shown below:

| $\Delta X/\Delta Y$ | Sign | Algorithm | Angle* |
|---|---|---|---|
| zero | × | 1 | 45° to 135° |
| nonzero | + | 2 | 0° to 45° |
| nonzero | − | 3 | 135° to 180° |

*All angles measured clockwise from the positive X axis.

It will be recalled that where the angle of the segment is greater than 45° from the horizontal the value $\Delta X/\Delta Y$, which is the integer portion of the quotient of $\Delta X$ divided by $\Delta Y$, is zero because $\Delta Y$ is greater than $\Delta X$. For segments in this range from 45° to 135° (noninclusive), control circuit 402 performs the first algorithm. Control section 402 is a synchronous state machine that changes state once every two system clocks, i.e., once every 320 nsec. Each state is further divided into two halves. The first state for each segment is used for initialization. Generally, during each subsequent state, the slope is added to the previous XPOS value during the first half state and a correction value is added, if necessary, during the second half state.

For algorithm 1, control circuit 402 initializes by loading XTOP into XPOS register 416 through multiplexer 418 during the first half state, setting control line 442 to select the A input of MUX 418 for initialization. During this half state, control line 426 is high, disabling NOR gate 448, and line 425 is low whereby gate 430 is low and 12-bit AND gate 428 is disabled. During the second clock cycle of this initialization phase, $-\Delta Y$ is loaded into accumulator 420. In order to load the accumulator, control circuit 402 sets the pair of control lines 422 to 4-to-1 MUX 424 to select the A input thereof. Also at this time, control line 425 is high to enable 12-bit AND gate 428 through OR gate 430. Control line 425 is high during subsequent first half states and low during corresponding second half states. Control line 432 is set to select the B input MUX 434, which receives the output of AND gate 428, and thus completes the data path from $-\Delta Y$ register 412 to accumulator 420.

During the first half state of the next state, $\Delta X/\Delta Y$ is added to the current X position which is stored in the XPOS register 416. However, since $\Delta X/\Delta Y$ equals zero in this case, the value XPOS does not change. The control line levels during this addition half state are as follows: Control lines 436 are set to select the A input to 4-to-1 MUX 400, control line 438 is set high to enable 12-bit AND gate 440, and control line 442 is set to select the B input of multiplexer 418. Thus, $\Delta X/\Delta Y$ (zero) is added in adder 444 to the current data in XPOS register 416, which initially is equal to XTOP. The resulting sum is returned to XPOS register 416 through MUX 418.

During this same half state, 2R, or two times the remainder value, is added to the value in accumulator 420. nput D of MUX 424 is selected by control circuit 402. Line 425 is high, enabling gate 428, and thus 2R appears at the B input of adder 446. Control line 432 is still set to select the A input of MUX 434 at this time, and so the sum output from adder 446 is returned to accumulator 420. The MSB in accumulator 420 is used as a carry out (CO) bit from the accumulator to control whether a correction is made to the value stored in XPOS register 416. A correction is necessary only if an overflow results from the addition, i.e., if accumulator 420 no longer contains a negative number, in which case the MSB is a zero. Any correction is performed during the second half state.

All 12 bits of accumulator 420 are coupled to the A input of adder 446, and the MSB is additionally supplied to the CO output and therefrom to NOR gates 448 and 450 and inverter 452. Gates 450 and 452 together control all 12 input lines of the D input of multiplexer 400. Gate 452 drives the LSB input while gate 450 drives the remaining 11 inputs. If no overflow results from the addition operation in adder 446, the CO line is high at the end of the first half state indicating that no correction is necessary. As a result of the high CO signal, the value of the input at the MUX 400 D input is zero, the LSB being held low through inverter 452 and all 11 high-order bits being held low through NOR gate 450. At this time control lines 436 are set to select the D input and gate 440 is still enabled. Consequently, during the second half state, zero is added in adder 444 to the XPOS value stored in register 416, the result being returned to XPOS register 416 through MUX 418.

The high CO output also holds NOR gate 448 low and, since line 425 is low during this half state, gate 428 is disabled and zero is added to the contents of the accumulator, thus no correction is made.

If the addition during the first half state does instead result in an overflow, a correction is required during the second half state. In this case, the CO output line is low and thus the LSB at the MUX 400 D input is high. The other 11 bits of the D input have the same value as the sign of $\Delta X$, which is stored in $\Delta XS$ register 408. Thus, if the sign bit is a "1" (negative number), all 12 inputs of the D input are "1" (binary $-1$), and thus $-1$ is added to the XPOS value stored in register 416 and the result is returned to register 416. However, if $\Delta X$ is positive, the sign bit is a "0" and thus the value at the D input equals $+1$. In this case the value in register 416 is incremented by 1. The low CO output of accumulator 420 goes to NOR gate 448 which also receives, at this time, a low input on control line 426. The result is that NOR gate 448 goes high and enables AND gate 428 through OR gate 430. Control circuit 402 selects the B input of MUX 424 and thereby adds $2(-\Delta Y)$ to the value in accumulator 420, storing the result back in the accumulator.

When the edge calculator has a valid edge coordinate in X output register 456, control circuit 402 activates the DATARDYL output to signal this event to horizontal line drawer 42. If horizontal line drawer 42 can accept the X coordinate, the LDLOAD input will be activated and edge calculator 34L will proceed to calculate the X coordinate of the next horizontal line in the polygon.

$\Delta Y$ counter 410 is loaded with a negative number when segment data is loaded. It is incremented after each X coordinate is calculated. When the counter value reaches $-1$, control section 402 senses that it is calculating the X coordinate of the second last line in the segment. No calculation is necessary for the last line of the segment since XBOT, the X coordinate of the bottom line of the segment, is already known and stored in X BOTTOM register 404. Control section 402 responds to this condition by setting control line 458 such that the A input of multiplexer 460 is selected and simultaneously activates control line 459 to cause output register 456 to be loaded with the value XBOT.

If $\Delta X/\Delta Y$ register 406 contains a nonzero value, control circuit 402 performs algorithm 2 or 3, depending upon the sign bit of $\Delta X/\Delta Y$. Briefly described, algorithm 2 consists of the following steps, each step taking one state, or two system clock periods:

1. Initialization.
   (a) first half state: load XTOP into XPOS register 416, and load remainder R into accumulator 420. Line 425 is high.
   (b) second half state: add zero to XPOS (line 438 is low), and store the results in register 416. Select $-\Delta Y$ or $2(-\Delta Y)$ and add the selected value to the value in the accumulator. Line 425 is high, thus, gate 428 is enabled. Control circuit 402 selects the A or B inputs of MUX 424 depending upon the LSB of $\Delta X/\Delta Y$: if the LSB is a one, the A input is selected and $-\Delta Y$ is added to the accumulator value; if the LSB is zero, $2(-\Delta Y)$ is added.
2. Second line of segment.
   (a) first half state: add $(\Delta X/\Delta Y)/2$ to the value in XPOS register 416.
   (b) second half state: add $+1$ to XPOS (select MUX 400 input C).
3. All subsequent lines of segment.
   (a) first half state: add $\Delta X/\Delta Y$ to XPOS. Add R to accumulator value.
   (b) add zero or $+$ or $-1$ to XPOS, depending upon the CO bit and $\Delta XS$. Also, add $2(-\Delta Y)$ to the accumulator value if CO is low.

The algorithm steps for algorithm 3 are as follows:

1. Initialization.
   (a) first half state: same as algorithm 2.
   (b) second half state: add $(\Delta X/\Delta Y)/2$ to XPOS. Add to accumulator 420 in the same manner as in algorithm 2.
2. Subsequent lines until last line.
   (a) first half state: add $\Delta X/\Delta Y$ to XPOS, and add R to the accumulator value.
   (b) same as step 3(b) in algorithm 2.
3. Last line.
   (a) first half state: load XBOT from X bottom register 404 into MUX 460.

The output coordinate from the edge calculator, XL, is a 12-bit number which is supplied to left window comparator 46L along lines 48L (FIG. 3). As shown in FIG. 3, XL is also supplied to top/bottom window comparator 50. The reason for this will become apparent after reading the description of window comparator 50. Along with DATARDYL, left edge calculator 34L supplies signal FSTL (first left) on lines 40L direct to horizontal line drawer 42. Right edge calculator 34R produces similar output signals, namely, right edge X coordinate XR on data lines 48R and control signals DATARDYR and FSTR on control lines 40R.

The FIRST signal indicates to control section 402 that the present segment is the first segment of a polygon. When edge calculator 34L outputs the X coordinate of the first line of the first polygon segment, output FSTL will be active.

VII. WINDOW COMPARATORS

Figure 8A:
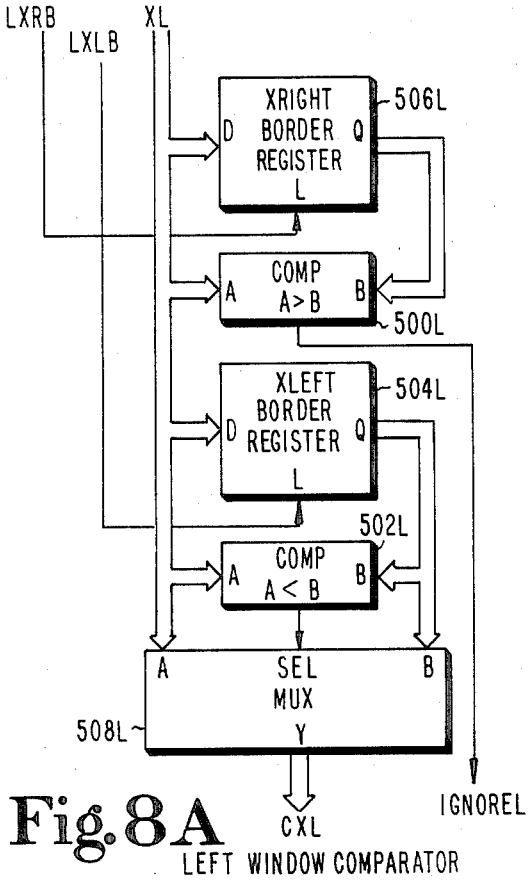
FIGS. 8A and 8B are block diagrams, respectively, of the left and right window comparators of FIG. 3.
Figure 8B:
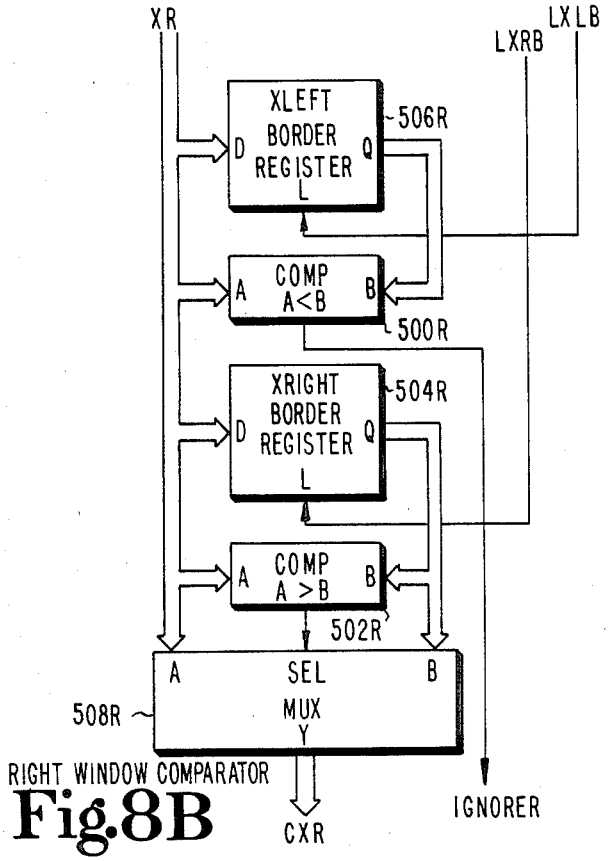

Referring now to FIGS. 8A and 8B, it will be seen that left window comparator 46L consists of two comparators, 500L and 502L, two border registers, XLEFT border register 504L and XRIGHT border register 506L, and multiplexer 508L. Similarly, right window comparator 46R consists of comparators 500R and 502R, XRIGHT border register 504R and XLEFT border register 506R, and multiplexer 508R.

The window comparators are used to clip the horizontal line output from the edge calculators to the currently active clipping window. The result of the clipping operator is sent to the horizontal line drawer 42. The clipping window is defined by data stored in the border registers. The data is loaded into the border registers by execution of LOAD instructions. The data word in the LOAD instruction is interpreted by execution unit 24 as an XTOP value and is transferred as such to edge calculators 34L and 34R which passes it through multiplexer 418, XPOS register 416, adder 444, multiplexer 460 and X output register 456 to output data lines 48L and 48R. Divider 26 passes the XTOP value through to data lines 32 without modification. Note that the LOAD instruction is similar to a one-vertex PDRW instruction with the data to be written into a border register in the position of the X coordinate of the vertex.

One border register is loaded per LOAD instruction, according to the following table:

| Active Control Line | Function |
|---|---|
| LXLB | Load XLEFT border register |
| LXRB | Load XRIGHT border register |
| LYBB | Load YBOTTOM border register |
| LYTB | Load YTOP border register |

It will be appreciated that a LOAD instruction is similar to a 1-vertex PDRW instruction with the register number in the position of the Y coordinate of the vertex.

As stated previously, a LOAD instruction causes one of the load control inputs to the window comparators to go high for loading a border register. If LXRB is the control line activated by a LOAD instruction being executed, the X coordinate value at the D input of XRIGHT border register 506L is loaded into that register. Similarly, LXLB, if activated, causes XLEFT border register 504L to be loaded. Right window comparator 46R operates identically, with the X coordinate data coming from right edge calculator 34R.

During a PDRW instruction, none of the load control inputs is high. The value XL appears at the A inputs of comparators 500L and 502L in which it is compared with the data previously loaded into border registers 506L and 504L, respectively. If XL is greater than the contents of border register 506L, the entire line is to the right of the clipping window and should not be drawn. In this case, the signal IGNOREL, which is applied to line drawer 42 on output line 60L, is activated and the line will not be drawn. If XL is less than the contents of XLEFT border register 504L, the left end point of the line is to the left of the clipping window. In this case, the select (SEL) input of multiplexer 508L goes high causing the data at the B input, which is the contents of border register 504L, to be used in place of XL in generating CXL, the left end point of the line that is sent to horizontal line drawer 42. It will of course be understood that if XL is less than the contents of X right border register 506L and greater than the contents of XLEFT border register 504L, the left end point of the line is inside the clipping window and therefore XL will be passed through multiplexer 508L unchanged to the CXL output.

Similarly, during a PDRW instruction, none of the load control inputs to right window comparator 46R is high. XR appears at the A inputs of comparators 500R and 502R in which it is compared with the data previously loaded into border registers 506R and 504R, respectively. If XR is less than the contents of border register 506R, the entire line is to the left of the clipping window and should not be drawn. In this case, the signal IGNORER, which is applied to line drawer 42 on output line 60R, is activated and the line will not be drawn. If XR is greater than the contents of XRIGHT border register 504R, the right end point of the line is to the right of the clipping window. In this case, the select (SEL) input of multiplexer 508R goes high causing the data at the B input, which is the contents of border register 504R, to be used in place of XR in generating CXR, the right end point of the line that is sent to horizontal line drawer 42. If XR is greater than the contents of XLEFT border register 506R and less than the contents of XRIGHT border register 504R, the right end point of the line is inside the clipping window and therefore XR will be passed through multiplexer 508R unchanged to the CXR output.

Figure 9:
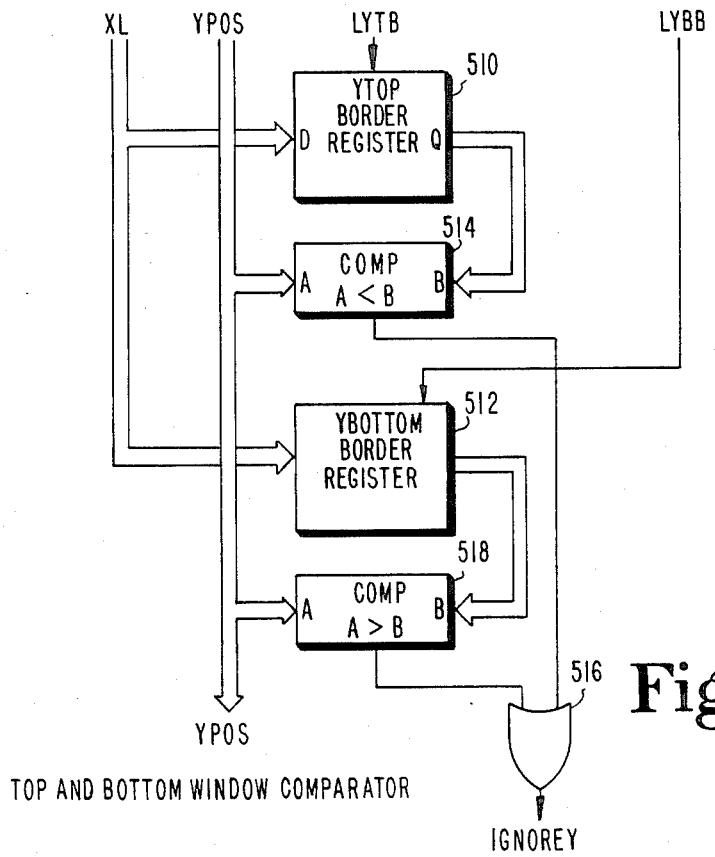
FIG. 9 is a diagram, partially in block diagram form and partially in schematic form, showing the top/bottom window comparator of FIG. 3.

Top/bottom window comparator 50, shown in detail in FIG. 9, compares the YPOS value coming from Y position calculator 36 to the contents of YTOP border register 510 and YBOTTOM border register 512. Loading of these border registers is identical in technique with that of the left and right window comparators, LYTB controlling the loading of YTOP border register 510 and LYBB controlling the loading of the bottom border register 512. If YPOS is less than the contents of YTOP border register 510, the line is above the clipping window and should not be drawn, and is prevented from being drawn by a high output signal from comparator 514 to OR gate 516. This causes the IGNOREY signal to horizontal line drawer 42 to go high. IGNOREY also goes high if YPOS is greater than the contents of YBOTTOM border register 512, comparator 518 supplying a high signal to OR gate 516 in this case. Of course, if YPOS is within the current clipping window, both comparator outputs are low, this IGNOREY is low and the YPOS output of the window comparator is used by horizontal line drawer 42 to draw a line, as will now be described.

VIII. HORIZONTAL LINE DRAWER

Figure 10:
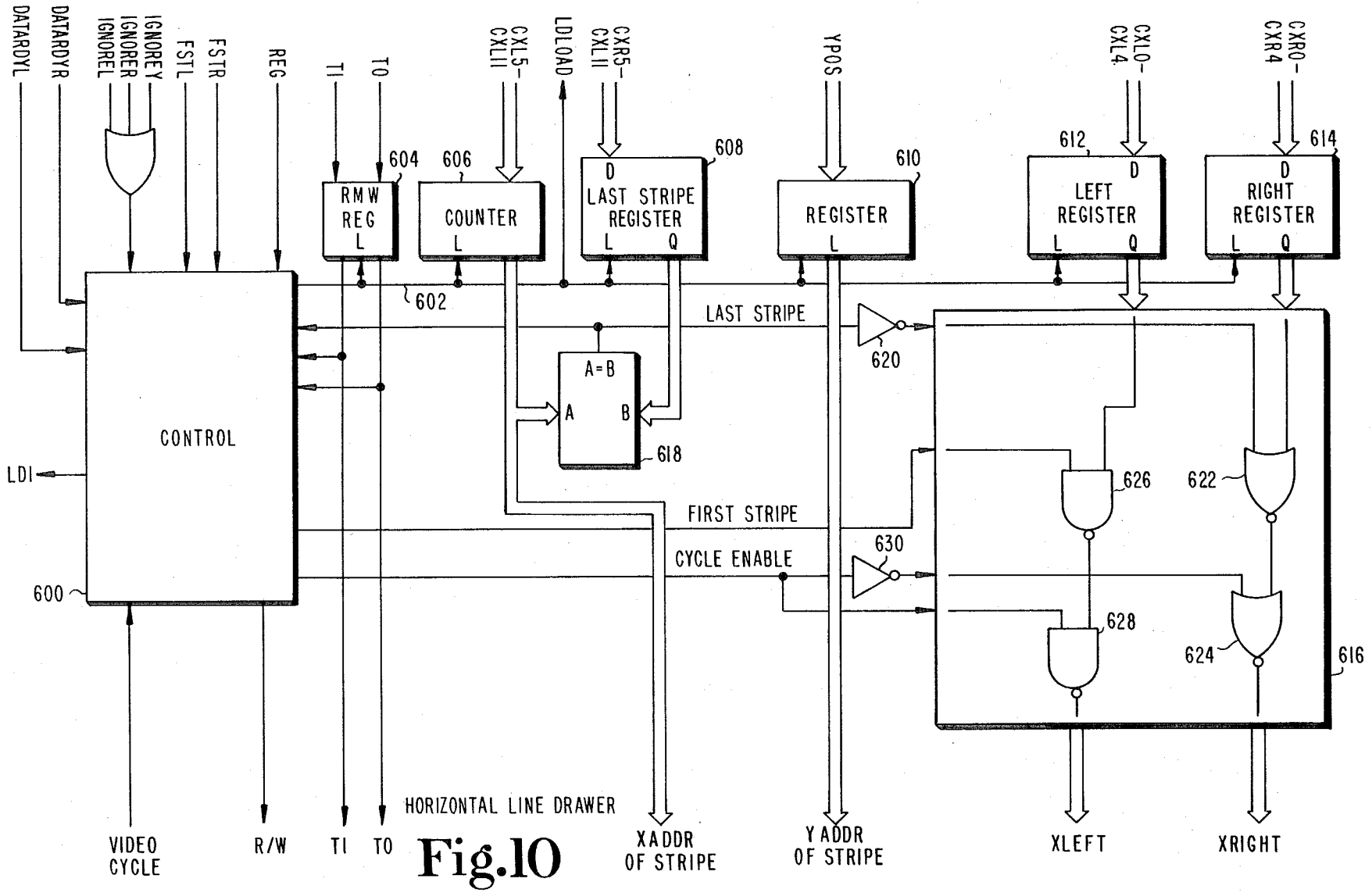
FIG. 10 shows the horizontal line drawer of FIG. 3, partially in block diagram form and partially in schematic form.

Referring now to FIG. 10, Horizontal line drawer 42 is shown in greater detail, partly in block diagram and partly schematic form. Horizontal line drawer 42 receives YPOS, CXL and CXR inputs from the window comparators and generates X and Y stripe address information and data representative of the left and right end pixels in the stripe which is addressed.

CXL and CXR are received, respectively, on lines 56L from left window comparator 46L and lines 56R from right window comparator 46R. The five low-order bits of each of these data words are separated from the seven high-order bits, as shown in FIG. 10. Top/bottom window comparator 50 supplies YPOS on lines 58, and IGNOREL, IGNORER and IGNOREY are received, respectively, on lines 60L, 60R and 62. REG, T1 and T0 are received on lines 54 from Y position calculator 36. DATARDYL is received from left edge calculator 34L with FSTL, and similarly, DATARDYR is received with FSTR on lines 40R.

When DATARDYL and DATARLDYR are active and line drawer 42 is not busy drawing a line, control secton 600 activates the LDLOAD (line drawer load) signal coupled to the load (L) inputs of RMW register 604, counter 606, LAST STRIPE register 608, register 610, left register 612 and right register 614, causing the input data to be loaded into those registers and the counter. LDLOAD is also fed back to edge calculators 34L and 34R and Y position calculator 36 on handshaking line 44 to inform them that they can calculate the coordinates of the next horizontal line in the polygon.

Five bits are required to indicate which one of thirty-two pixels in the address stripe is the left end pixel of the line to be written into the frame buffer. Similarly, five bits are required for the right end pixel in the stripe. The two end pixels just described are identified by CXL0–CXL4 stored in left register 612, while the five bits CXR0–CXR4 stored in right register 614 represent the right end pixel. CXL and CXR are gated through logic circuit 616, under conditions which will be described, to outputs XLEFT and XRIGHT, respectively, from which they are coupled to Write Enable Generator 72. CXL5–CXL11 and CXR5–CXR11 are X stripe addresses of the left and right end points of the horizontal line. Since the direction of the raster scan is from left to right, CXR5–CXR11 represent the last stripe in the line of the polygon, and accordingly that data is loaded into LAST STRIPE register 608. CXL5–CXL11 are loaded into counter 606 which is incremented once each frame buffer memory cycle under control of control circuit 600.

Control section 600 monitors the VIDEO CYCLE input which determines which memory cycles are available to the horizontal line drawer to write data into the frame buffer. If the next memory cycle is available and the conditions are otherwise such that a stripe should be written into the frame buffer, control circuit 600 activates the FIRST STRIPE and CYCLE ENABLE outputs during the next memory cycle. If the data in counter 606 does not equal the data in LAST STRIPE register 608, which is determined by comparator 618, the LAST STRIPE signal is low. Inverter 620 inverts the LAST STRIPE signal and supplies it to logic circuit 616, which also receives the FIRST STRIPE signal as well as both the inverted and non-inverted CYCLE ENABLE signal as shown in FIG. 10.

Logic circuit 616 has five identical circuits of the type shown in block 616, each such circuit including two NOR gates 622 and 624 and two NAND gates 626 and 268. Each such logic circuit controls the gating for one bit of the five low-order CXL and CXR bits.

Each of the five bits in CXR0–CXR4 is associated with a pair of NOR gates 622 and 624, and each bit in CXL0–CXL4 is likewise associated with a pair of NAND gates 626 and 628. Inverter 620 is connected to all five NOR gates 622 in logic circuit 616 and thereby simultaneously controls the gating of all five bits of CXR. Similarly, the FIRST STRIPE line is connected to all five NAND gates 626, CYCLE ENABLE is coupled to all NAND gates 628, and inverter 630 supplies the inverted CYCLE ENABLE signal to all NOR gates 624.

It will be appreciated by those skilled in the art that for stripes entirely within the polygon, all pixels within the stripe are modified during a memory write cycle, whereas for the stripes intersected by the left and right edges of the polygon, i.e., the first and last stripes, a portion of the pixels in each stripe is not modified. It will be further appreciated that for a horizontal line of a polygon which is less than 32 pixels wide, only the pixels inside the polygon need to be modified while those pixels to the left and right of the polygon edges are not to be modified. The present graphics system implements these functions in a manner which will now be described.

If LAST STRIPE is low, indicating that the current stripe is not the last stripe of the horizontal line through the polygon, the resulting high output signal from inverter 620 disables NOR gate 622. If the current stripe is the first stripe, FIRST STRIPE is high enabling NAND gate 626. If the line is to be drawn during the first available memory cycle after data is loaded into the horizontal line drawer 24, the CYCLE ENABLE and FIRST STRIPE outputs of control section 600 become active, and therefore the corresponding inputs of NAND gates 626 and 628 are high and CXL data is passed through logic circuit 616 to the XLEFT output of line drawer 42. In this situation the output of each NOR gate 622 is zero and the output of each NOR gate 624 is one, causing the five bits of XRIGHT all to be set to one. Consequently, as will become more apparent after the ensuing discussion of the write enable generator, all pixels in the addressed stripe between the including pixel number XLEFT and pixel number 31 are modified during the memory cycle. At the end of the memory cycle, counter 606 is incremented and the process continues. Similarly, for the last stripe in the horizontal line, LAST STRIPE and CYCLE ENABLE are high while FIRST STRIPE is low, thus gates 622 and 624 each have a corresponding low input enabling CXR0–CXR4 to pass through the XRIGHT output. The low FIRST STRIPE input to gate 626 causes the gate to go high and, since CYCLE ENABLE is high, gate 628 goes low. Thus, for the last stripe, XRIGHT equals CXR0 and XLEFT equals zero. This set of XLEFT and XRIGHT data causes all pixels in the addressed stripe between the including pixel numbers zero and XRIGHT to be modified. After this memory cycle, control section 600 is ready to load new data into the input registers.

During the first available memory cycle following the drawing of the first stripe into the frame buffer, CYCLE ENABLE is the only active signal of the three control signals supplied to logic circuit 616. This set of conditions causes all zeros to be placed on the XLEFT output and all ones to be placed on the XRIGHT outputs. As will be seen, this causes all pixels in the addressed stripe to be modified during the memory cycle. At the end of this memory cycle, counter 606 is incremented by control circuit 600.

The CYCLE ENABLE signal is generated by control circuit 600 as a function of IGNOREL, IGNORER, IGNOREY and REG in addition to the VIDEO CYCLE input. If any one of these inputs is a "1," control section 600 keeps CYCLE ENABLE low. One circumstance in which this occurs is when the next memory cycle is to be used to read data from the frame buffer to refresh the CRT, in which case VIDEO CYCLE is active. This also occurs when the line is to be ignored because it is entirely outside the clipping window or when the current instruction is a LOAD instruction, in which the input data to horizontal line drawer 42 is not line data, but merely the remains of a LOAD instruction. In any of these cases, CYCLE ENABLE is low, thereby disabling NAND gate 628 and, through inverter 630, NOR gate 624. Thus all bits of XLEFT will be set to "1" whereas all bits of XRIGHT will be set to "0" which prevents write enable generator 72 from generating any write enable outputs to the frame buffer. Therefore no pixels are modified.

The values of T0 and T1 stored in RMW register 604 are supplied to control circuit 600 in addition to being passed to the output lines T0 and T1. If either one of these signals is high, a read-modifiy-write as being requested, and control section 600 responds by incrementing counter 606 after every other memory cycle, thus causing two memory cycles to be executed for each stripe address. During the first cycle, the R/W output of control circuit 600 is high indicating a memory read. During the second cycle, the R/W output is low indicating a memory write. T0 and T1 indicate what type of read-modify-write is to be done, as will be described hereinafter.

The FSTL and FSTR inputs to control section 600 indicate that the horizontal line to be drawn is the first line of a polygon. Control section 600 activates output LD1 during the first memory cycle of the first line of a polygon, which causes the polygon color word to be loaded into data register 2.

IX. WRITE ENABLE GENERATOR

Write enable generator 72 receives XLEFT and XRIGHT from horizontal line drawer 42 and causes all pixels in frame buffer 64 between and including pixel XLEFT and XRIGHT to be modified by generating write enable outputs to all RAMs in the frame buffer from RAM XLEFT through RAM XRIGHT.

Figure 11:
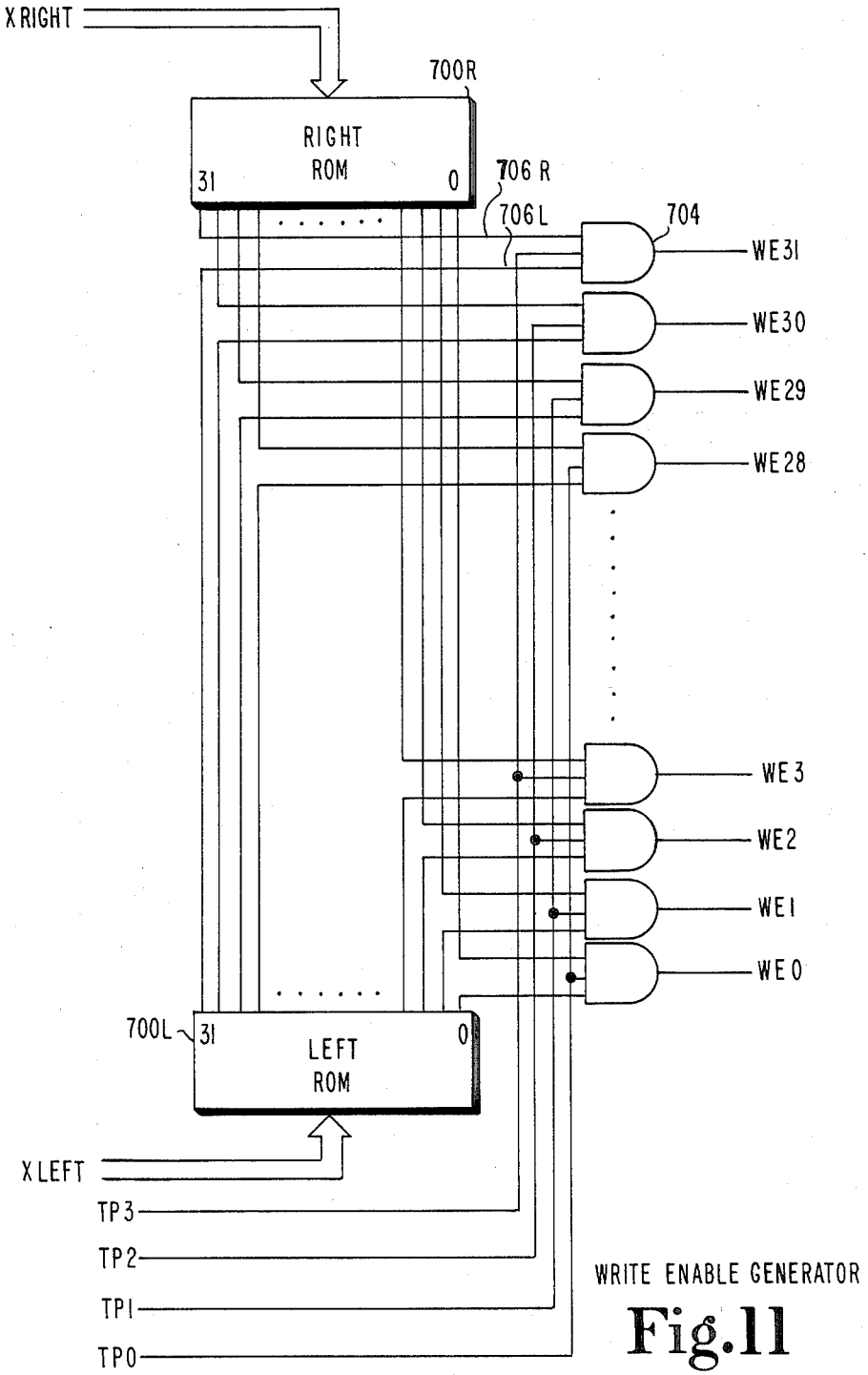
FIG. 11 shows write enable generator 72 of FIG. 3 partially in schematic form and partially in block diagram form.
Figure 12:
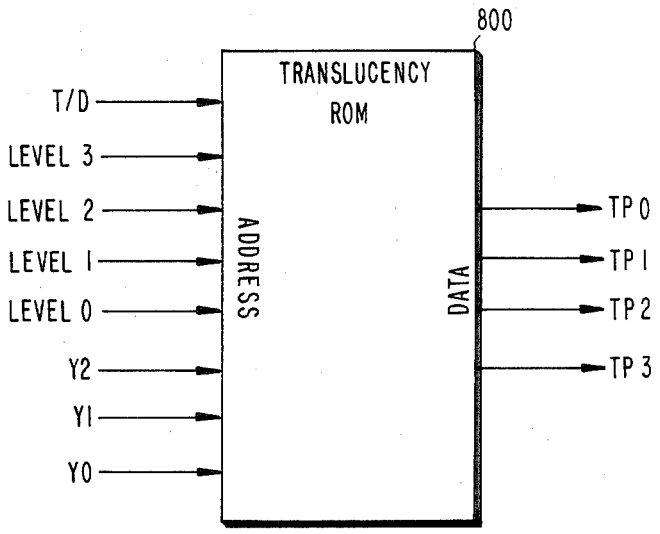
FIG. 12 illustrates the signal inputs and outputs of the translucency pattern generator of FIG. 3.

As shown in FIG. 11, write enable generator 72 includes a left ROM 700 and a right ROM 700R, the outputs of which are connected to a set of AND gates 704. Write enable generator 72 includes 32 WE output lines to the WE inputs of frame buffer 64 and 32 corresponding output lines from each ROM, although for ease of illustration, not all of these outputs are shown. Write enable generator 72 performs a logical AND operation on the two 32-bit output words from left and right ROMs 700L and 700R, assuming that all the TP inputs are high, as will be described.

The block diagram and description of the write enable generator applies to a system designed with a frame buffer with 32 pixels per stripe. All concepts apply equally well to a system with a different number of pixels per stripe.

Assuming all of the TR inputs are ones, the write enable generator will generate a write enable to all RAMs in the frame buffer between and including RAM number XLEFT and RAM number XRIGHT. In this manner the write enable generator causes all pixels between and including pixel number XLEFT and number XRIGHT to be modified. Below is a listing of the data in the Left ROM and the Right ROM.

TABLE

| ADDRESS | LEFT ROM 700L (0 … 31) | RIGHT ROM 700R (0 … 31) |
|---|---|---|
| 0 | 11111111111111111111111111111111 | 10000000000000000000000000000000 |
| 1 | 01111111111111111111111111111111 | 11000000000000000000000000000000 |
| 2 | 00111111111111111111111111111111 | 11100000000000000000000000000000 |
| 3 | 00011111111111111111111111111111 | 11110000000000000000000000000000 |
| 4 | 00001111111111111111111111111111 | 11111000000000000000000000000000 |
| 5 | 00000111111111111111111111111111 | 11111100000000000000000000000000 |
| 6 | 00000011111111111111111111111111 | 11111110000000000000000000000000 |
| 7 | 00000001111111111111111111111111 | 11111111000000000000000000000000 |
| 8 | 00000000111111111111111111111111 | 11111111100000000000000000000000 |
| 9 | 00000000011111111111111111111111 | 11111111110000000000000000000000 |
| 10 | 00000000001111111111111111111111 | 11111111111000000000000000000000 |
| 11 | 00000000000111111111111111111111 | 11111111111100000000000000000000 |
| 12 | 00000000000011111111111111111111 | 11111111111110000000000000000000 |
| 13 | 00000000000001111111111111111111 | 11111111111111000000000000000000 |
| 14 | 00000000000000111111111111111111 | 11111111111111100000000000000000 |
| 15 | 00000000000000011111111111111111 | 11111111111111110000000000000000 |
| 16 | 00000000000000001111111111111111 | 11111111111111111000000000000000 |
| 17 | 00000000000000000111111111111111 | 11111111111111111100000000000000 |
| 18 | 00000000000000000011111111111111 | 11111111111111111110000000000000 |
| 19 | 00000000000000000001111111111111 | 11111111111111111111000000000000 |
| 20 | 00000000000000000000111111111111 | 11111111111111111111100000000000 |
| 21 | 00000000000000000000011111111111 | 11111111111111111111110000000000 |
| 22 | 00000000000000000000001111111111 | 11111111111111111111111000000000 |
| 23 | 00000000000000000000000111111111 | 11111111111111111111111100000000 |
| 24 | 00000000000000000000000011111111 | 11111111111111111111111110000000 |
| 25 | 00000000000000000000000001111111 | 11111111111111111111111111000000 |
| 26 | 00000000000000000000000000111111 | 11111111111111111111111111100000 |
| 27 | 00000000000000000000000000011111 | 11111111111111111111111111110000 |
| 28 | 00000000000000000000000000001111 | 11111111111111111111111111111000 |
| 29 | 00000000000000000000000000000111 | 11111111111111111111111111111100 |
| 30 | 00000000000000000000000000000011 | 11111111111111111111111111111110 |
| 31 | 00000000000000000000000000000001 | 11111111111111111111111111111111 |

XLEFT and XRIGHT are supplied, respectively, to the address input lines of left ROM 700L and right ROM 700R. For example, if XLEFT has a value of 1 and XRIGHT has a value of 3, the only active WE outputs will be WE1, WE2, and WE3 because bit 0 of left ROM 700L is a "0" and only the four LSBs of right ROM 700R are ones. As noted previously, if CYCLE ENABLE is low, horizontal line drawer 42 will set XLEFT equal to 31 and XRIGHT equal to 0. In this situation, as can be seen from the above ROM listing, left ROM 700L produces a high output only for bit 31 while the right ROM 700R produces a high output only for bit 0. Consequently, no WE output lines are activated and no pixels are modified in the frame buffer.

X. TRANSLUCENCY PATTERN GENERATOR

Translucency is achieved by overlaying the display screen with repeated copies of a pattern four pixels wide by eight pixels high. Since the system resolution for the preferred implementation is 576 pixels wide by 448 pixels high, the pattern is repeated 144 times (576÷4) horizontally and 228 times (448÷8) vertically. The pattern is created one strip at a time generating appropriate transparency pattern output bits TP0–TP3 which, as has been described, control the output AND gates in write enable generator 72. Referring again to FIG. 11, each of the TP bits is supplied to every fourth AND gate in the set of AND gates 704, as shown in the drawing. Thus it will be appreciated that the pattern contains one bit per pixel and is repeated eight times in the addressed stripe. If the TP bit is a "1" the corresponding pixel in the frame buffer is allowed to be modified during a memory write cycle. If the TP bit is a "0" the corresponding pixel is inhibited from being modified and the pixel value previously in the frame remains visible. It can be seen that the translucency pattern of the polygon is usually controlled by controlling the four TP data bits. If all four TP bits are high, all the pixels in the polygon are modified and thus the polygon is totally opaque whereas, if all four TP bits are low, the polygon will be totally transparent. If the pattern contains more ones the polygon will appear more opaque, and if it contains more zeros the polygon appears more transparent.

Transparency pattern bits TP0–TP3 are specified by the T/D and LEVEL0–LEVEL3 siganls which are supplied to five of the address lines of ROM 800. These signals are the same as the T/D and LEVEL bits in the second word of the PDRW instruction and are stored in data register 2 as part of the polygon color word. If T/D is low, all outputs of ROM 800 are high, which causes the polygon to be totally opaque. With translucency selected by a high T/D bit, the four LEVEL input signals specify one of 16 translucency patterns which are stored in the ROM. As stated previously, each pattern is eight lines high, and thus eight 4-bit words are stored in ROM 800 to represent eight lines of the pattern. The three least significant bits of the Y address, Y0–Y2, determine which line of the pattern is to be used.

XI. DITHER PATTERN GENERATOR

Figure 13:
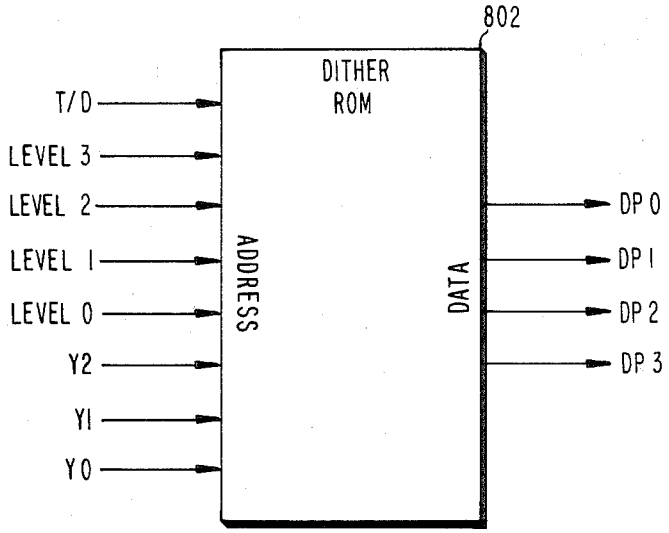
FIG. 13 shows the signal inputs and outputs of the dither pattern generator of FIG. 3.

Dither pattern generator 90 consists of a dither ROM 802, as shown in FIG. 13, which is used to provide a stippling or dither effect. This effect is produced in much the same way as the translucency effect, the difference being that the state of a bit in the dither pattern determines which of two data values will be written into the corresponding pixel location in the frame buffer. It will be recalled that the second word of the PDRW instruction contains a DATAH and DATAL data word. If any particular DP (dither pattern) bit is low, DATAL is written into the corresponding pixel location. If the bit is high, DATAH is written into the corresponding pixel location. It will thus be appreciated that the apparent color of the polygon is a programmable mixture of the color defined by DATAL and the color defined by DATAH depending upon the pattern of ones and zeros on the DP lines out of dither ROM 802 to VSR 80 (FIG. 3). By using this technique the system can appear to display many more than 16 colors at one time while storing only four bits per pixel in the frame buffer.

Dither ROM 802 receives the same address inputs as translucency ROM 800. If T/D is high, all outputs of ROM 802 are low causing DATAL to be written to every pixel of the polygon. If T/D is low, LEVEL-0–LEVEL3 specify one of 16 dither patterns, with the three LSBs of the Y address determining which line of the pattern is to be read out for the currently addressed stripe. In an alternative embodiment the dither and translucency pattern generators are both arranged with patterns 8 pixels wide by 8 pixels high.

XII. VIDEO SHIFT REGISTER

Figure 14:
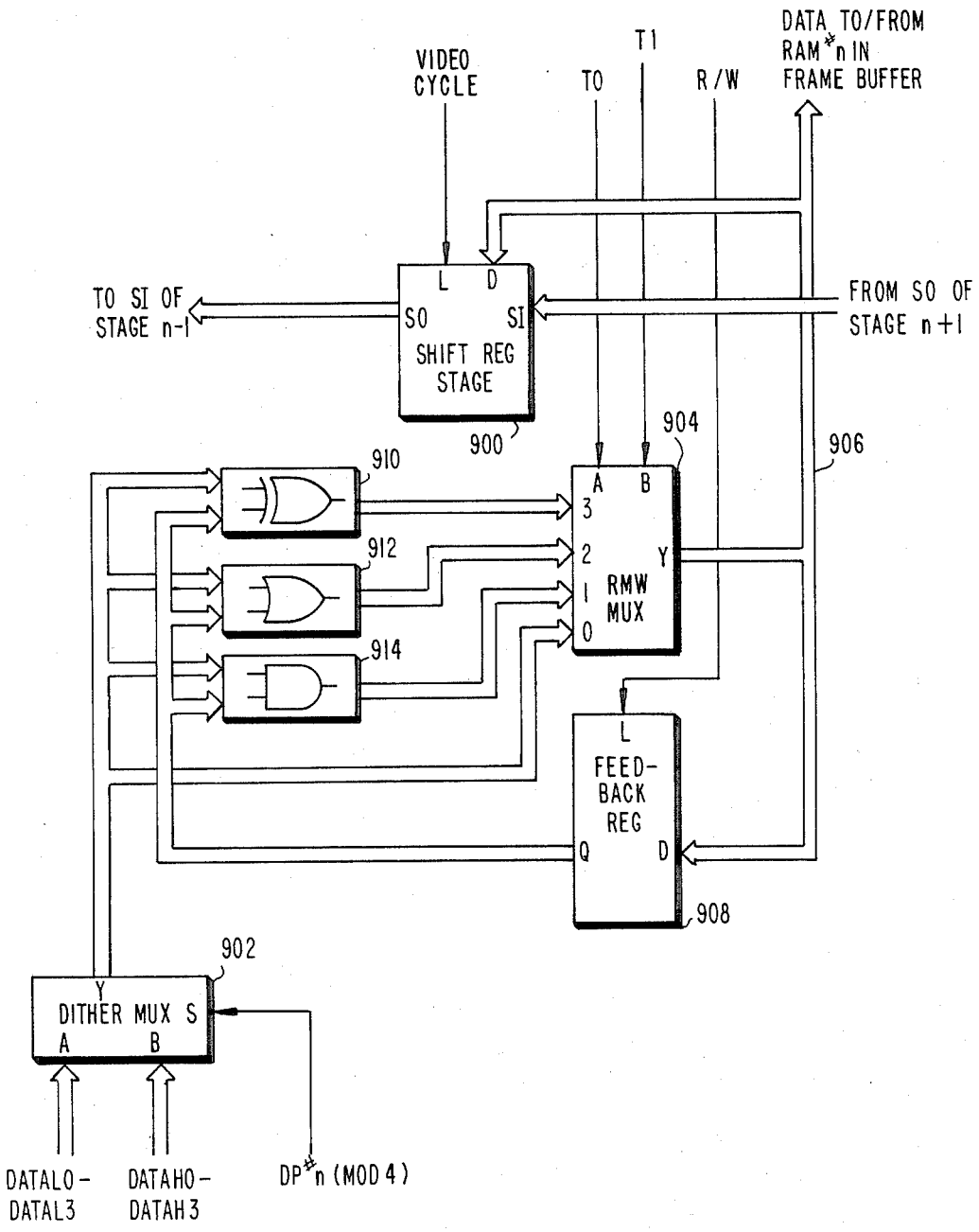
FIG. 14 shows a typical stage of the shift register, read-modify-write and dither circuitry included in the video shift register shown in FIG. 3.

FIG. 14 shows the shift register, read-modify-write and dither circuitry associated with one pixel in the 32-pixel stripe. It will be understood that VSR 80 includes 32 identical such circuits, one stage for each pixel. Returning momentarily to FIG. 3, the two 4-bit data words DATAH and DATAL, stored in data register 2, are supplied to the DITHER MUX (DM) input of VSR 80. Each STAGE N of VSR 80 includes a Shift Register Stage 900 having its shift-in (SI) input connected to the shift-out (SO) output of stage N+1, which is associated with the pixel immediately to the right of the pixel in RAM #N of the frame buffer. Shift Register Stage 900 is connected to RAM #N by Data Bus 906. The SO output of Shift Register Stage 900 is connected to the SI input of Stage N−1, which is associated with the adjacent pixel to the left. The data at the DM inputs of VSR 80 (FIG. 3) is coupled to the A and B inputs of DITHER MUX 902, which has a select (S) input connected to one of four DP input lines from Dither Generator 90. The DP input is one of the four signals DP0–DP3 supplied by dither pattern generator 90, and each DP signal is supplied to every fourth adjacent stage in VSR 80 to produce a pattern like that already described with respect to write enable generator 72. Depending upon the value of the DP #n bit, DATAL or DATAH is supplied to output Y of DITHER MUX 902 which is coupled either directly to RMW MUX 904 or indirectly through exclusive-OR gate 910, OR gate 912 or AND gate 914. Gates 910, 912 and 914 are all 4-bit gates. Data is written into the frame buffer through RMW MUX 904 the output of which is connected to data bus 906.

When the VIDEO CYCLE input is active, the data at the addressed memory location of frame buffer 64 is loaded into VSR 80, one 4-bit pixel value per shift register stage 900. When VIDEO CYCLE is not active VSR 80 shifts the data from the SO output of one shift register stage to the SI input of the next stage. VSR 80 operates with a shift register clock having a period equal to 80 nsec., thus four pixels are shifted out of VSR 80 for every frame buffer memory cycle (320 nsec.).

For data which is to be written without modification into the frame buffer, T0 and T1 are both set low thereby selecting the zero input to MUX 904. In this case, the output data from DITHER MUX 902 is place on data bus 906 and stored in the frame buffer.

The read-modify-write feature is used to fill in polygons with pixel values that are logical combinations of the pixel value defined in the PDRW instruction and the pixel values already in the frame buffer. The logical combinations, AND, OR and exclusive-OR allow the bit planes in the frame buffer to be accessed and modified independently. The operation of VSR 80 is controlled by signals T0, T1 and R/W which are supplied to the RMW input of VSR 80 by horizontal line drawer 42 (FIG. 3). As was stated previously, the control section in horizontal line drawer 42 activates the R/W line when a read-modify-write operation is to be performed, causing the data from RAM #n in frame buffer 64 to be loaded into feedback register 908. During the next memory cycle a write cycle is executed in which the data at the output of RMW MUX 904 is written into the frame buffer. T0 and T1, control MUX 904 and determine what type of modification is to be performed on the data coming from the frame buffer. The circuitry just described permits the host processor to access the frame buffer by performing read-modify-write operations on individual pixels. Although the illustrated implementation performs only AND, OR and exclusive-OR operations, other kinds of modification are possible. For example, a RAM or ROM may be employed in place of the logic gates shown in FIG. 14, with the data output of the RAM or ROM coupled to data buffer 906 and the address inputs driven by the outputs of feedback register 908 and DITHER MUX 902.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A high-speed video graphics system for generating filled polygons on a raster display screen from X-Y vertex coordinates of said polygons, said system comprising:

(a) means for receiving polygon data, said polygon data including pixel video data and the X-Y vertex coordinates for each polygon, said pixel data representing selected video attributes;

(b) calculating means for calculating from said X-Y vertex coordinates the X coordinates of the left and right edges of said polygons for each horizontal line of said display, said calculating means including (1) subtraction means for calculating $\Delta X$ and $\Delta Y$ for first and second horizontally opposed segments of each polygon from the X-Y vertex coordinates for the endpoints of said first and second segments, respectively;

(2) divider means coupled to said subtraction means for calculating the slopes of said first and second segments from the respective values of $\Delta X$ and $\Delta Y$;

(3) edge calculator means coupled to said divider means and responsive to said slopes of said first and second segments for calculating the left and right edge X coordinates of a first horizontal line between said first and second segments; and (4) means for controlling said subtraction means, divider means and edge calculator means to effect parallel processing of data corresponding to said first and second horizontally opposed segments;

(c) a frame buffer having a plurality of sections each corresponding to a plurality of adjacent pixels defining a video frame portion, said frame buffer sections each including a memory location for each associated pixel;

(d) means for writing said pixel data simultaneously into the frame buffer memory locations which correspond to a selected plurality of pixels in a selected frame portion, said writing means having a control input coupled to said calculating means; and (e) means for reading said pixel data out of said frame buffer to refresh the display screen.

2. The video graphics system of claim 1 wherein said frame portion is a horizontal stripe of pixels, said raster display has a scan rate of at least 15 frames per second, and said writing means includes means for generating a stripe address corresponding to a selected stripe.

3. The video graphics system of claim 2 wherein said frame buffer is a semiconductor memory having an address input, a data input/output coupled to all memory locations in said buffer for said selected stripe in response to a single address word supplied to said address input, and a plurality of separate write enable inputs each coupled to a respective one of said memory locations for said selected stripe;

and wherein said writing means includes means for generating write enable signals for each of said write enable inputs.

4. The video graphics system of claim 3 wherein said edge X coordinates are binary numbers each having high-order and low-order bits;

said writing means includes (1) means coupled to said frame buffer address input for generating a stripe address in response to the high-order bits of the left edge X coordinate for said first horizontal line and for incrementing said stripe address for each successive stripe in said first horizontal line; and (2) means for generating addresses for the left and right end pixels in an addressed stripe, said end pixel address generating means being responsive to the low-order bits of said left edge X coordinate and of the corresponding right edge X coordinate for said particular line;

and wherein said write enable signal generating means includes (1) left and right ROMs, each ROM having n words of memory each n bits wide, each bit being associated with a predetermined write enable input and programmed in a state corresponding to a desired write enable signal, said left and right ROMs being addressed by said left and right end pixel addresses, respectively; and (2) logic circuit means for combining the outputs of said left and right ROMs.

5. The video graphics system of claim 4 wherein said receiving means includes an instruction execution unit operative to decode and execute instructions stored in a RAM shared by said video graphics system and a host processor, said execution unit including access means for accessing said shared RAM on alternate memory cycles thereof;

and wherein said writing means is operative to write pixel data into said frame buffer for said first horizontal line while said edge calculator means operates on a subsequent horizontal line between said first and second segments.

6. The video graphics system of claim 5 wherein said stripes are at least 16 pixels wide and wherein said pixel data includes at least 4 bits per pixel.

7. The video graphics system of claim 6 wherein said receiving means and calculating means operate synchronously in response to a system clock signal; and wherein said divider means completes a slope calculation in twelve or fewer cycles of said system clock.

8. The video graphics system of claim 1 wherein said frame buffer is a semiconductor memory having an address input, a data input/output coupled to all memory locations in said buffer for said frame portion in response to a single address word supplied to said address input, and a plurality of separate write enable inputs each coupled to a respective one of said memory locations for said frame portion;

and wherein said writing means includes means for generating write enable signals for each of said write enable inputs.

9. The video graphics system of claim 8 wherein said edge X coordinates are binary numbers each having high-order and low-order bits;

and wherein said write enable signal generating means includes ROM means for storing a plurality of enable bit patterns, each bit pattern corresponding to a desired set of write enable signals, said ROM means having an address input coupled to said calculating means.

10. The video graphics system of claim 1 wherein said receiving means includes an instruction execution unit operative to decode and execute instructions stored in a RAM shared by said video graphics system and a host processor, said execution unit including access means for accessing said shared RAM on alternate memory cycles thereof;

and wherein said writing means is operative to write pixel data into said frame buffer for said first horizontal line while said edge calculator means operates on a subsequent horizontal line between said first and second segments.

11. The video graphics system of claim wherein said frame portion is a horizontal stripe of at least 16 pixels and wherein said pixel data includes at least 4 bits per pixel.

12. The video graphics system of claim 1 wherein said receiving means and calculating means operate synchronously in response to a system clock signal; and wherein said divider means completes a slope calculation in twelve or fewer cycles of said system clock.

13. A method of generating filled polygons on a raster display screen from X-Y vertex coordinates of said polygons, said method comprising the steps:

(a) receiving polygon data including the X-Y vertex coordinates of a particular polygon and pixel video data representing selected video attributes for said particular polygon;

(b) calculating from said X-Y vertex coordinates the X coordinates of the left and right edges of said particular polygon for each horizontal line of said display, said calculating step including (1) calculating $\Delta X$ and $\Delta Y$ for first and second horizontally opposed segments of said particular polygon from the X-Y vertex coordinates for the endpoints of said first and second segments, respectively;

(2) calculating the slopes of said first and second segments from the respective values of $\Delta X$ and $\Delta Y$; and (3) calculating from said slopes of said first and second segments the left and right edge X coordinates of a first horizontal line between said first and second segments;

wherein the operations defining said calculating step are controlled to effect parallel processing of data corresponding to said first and second horizontally opposed segments;

(c) writing said pixel data simultaneously into a frame buffer in memory locations which correspond to a selected plurality of pixels in a selected video frame portion; and (d) reading said pixel data out of said frame buffer to refresh the display screen.

14. The method of claim 13 wherein said writing step is performed for said first horizontal line while the edge X coordinates are calculated for a subsequent horizontal line between said first and second segments.

15. A high-speed video graphics system for generating filled polygons on a raster display screen from X-Y vertex coordinates of said polygons, said system comprising:

(a) means for receiving polygon data, said polygon data including pixel video data and the X-Y vertex coordinates for each polygon, said pixel data representing selected video attributes;

(b) calculating means for calculating from said X-Y vertex coordinates the X coordinates of the left and right edges of said polygons for each horizontal line of said display, said calculating means including (1) subtraction means for calculating $\Delta X$ and $\Delta Y$ for first and second horizontally opposed segments of each polygon from the X-Y vertex coordinates for the endpoints of said first and second segments, respectively;

(2) divider means coupled to said subtraction means for calculating the slopes of said first and second segments from the respective values of $\Delta X$ and $\Delta Y$;

(3) edge calculator means coupled to said divider means and responsive to said slopes of said first and second segments for calculating the left and right edge X coordinates of a first horizontal line between said first and second segments; and (4) means for controlling said subtraction means, divider means and edge calculator means to effect parallel processing of data corresponding to said first and second horizontally opposed segments;

(c) a frame buffer having a plurality of sections each corresponding to a plurality of adjacent pixels defining a video frame portion, said frame buffer sections each including a memory location for each associated pixel;

(d) means for writing said pixel data simultaneously into all frame buffer memory locations, in a selected frame buffer section, which correspond to pixels between said left and right edge X coordinates of said first horizontal line; and (e) means for reading said pixel data out of said frame buffer to refresh the display screen.

16. The video graphics system of claim 15 wherein said frame portion is a horizontal stripe of at least 16 adjacent pixels and wherein said pixel data includes at least 4 bits per pixel.

* * * * *